US006184610B1

(12) United States Patent
Shibata et al.

(10) Patent No.: US 6,184,610 B1
(45) **Date of Patent: *Feb. 6, 2001**

(54) ELECTRON-EMITTING DEVICE, ELECTRON SOURCE AND IMAGE-FORMING APPARATUS

(75) Inventors: Masaaki Shibata, Kanagawa-ken; Masato Yamanobe, Machida; Takeo Tsukamoto, Atsugi; Keisuke Yamamoto, Yamato; Yutaka Arai, Atsugi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/690,964

(22) Filed: Aug. 1, 1996

(30) Foreign Application Priority Data

| | | |
|---|---|---|
| Aug. 3, 1995 | (JP) | 7-216527 |
| Aug. 3, 1995 | (JP) | 7-216542 |
| Aug. 3, 1995 | (JP) | 7-216543 |
| Jul. 26, 1996 | (JP) | 8-197272 |

(51) Int. Cl.[7] ..... H01J 1/30

(52) U.S. Cl. ..... 313/309; 313/336; 313/351; 313/310; 445/24

(58) Field of Search ..... 313/309, 336, 313/351, 310, 346 DC, 355, 306, 495; 445/24, 50, 51

(56) References Cited

U.S. PATENT DOCUMENTS

| | | | | |
|---|---|---|---|---|
| 4,954,744 | | 9/1990 | Suzuki et al. | 313/336 |
| 5,066,883 | * | 11/1991 | Yoshioka et al. | 313/309 |
| 5,285,129 | * | 2/1994 | Takeda et al. | 313/346 |
| 5,986,389 | * | 11/1999 | Tsukamoto | 313/310 |

FOREIGN PATENT DOCUMENTS

| | | | |
|---|---|---|---|
| 0251328 | * | 7/1987 | (EP) . |
| 0660357 | * | 6/1994 | (EP) . |
| 0725413 | * | 1/1996 | (EP) . |
| 64-31332 | * | 2/1989 | (JP) . |
| 1186740 | * | 7/1989 | (JP) . |
| 1213749 | * | 8/1989 | (JP) . |
| 2257552 | * | 10/1990 | (JP) . |

OTHER PUBLICATIONS

Advances in Electronics and Electron Physics, vol. VIII, 1956, W.P. Dyke et al., "Field Emission", pp. 91–185.*

Journal of Applied Physics, vol. 47, No. 12, Dec. 1976, C.A. Spindt et al., "Physical properties of thin–film field emission cathodes with molybdenum cones", 5248–5263.*

Journal of Applied Physics, vol. 32, Jan.–Dec., 1961, C.A. Mead, "Operation of Tunnel–Emission Devices", pp. 646–652.*

Radio Engineering and Electronic Physics, Jul. 1965, M.I. Elinson et al., "The Emission Of Hot Electrons And The Field Emission Of Electrons From Tin Oxide", pp. 1290–1296.*

(List continued on next page.)

*Primary Examiner*—Nimeshkumar D. Patel
*Assistant Examiner*—Joseph Williams
(74) *Attorney, Agent, or Firm*—Fitzpatrick, Cella, Harper & Scinto

(57) ABSTRACT

An electron-emitting device comprises a pair of oppositely disposed device electrodes and an electroconductive film electrically connecting the device electrodes and having an electron-emitting region formed as part thereof. The electroconductive film is partly or entirely covered by a metal oxide coat containing as principal ingredient with a melting point higher than that of the material of principal ingredient of the electroconductive film. The electroconductive film has also a deposited layer comprising carbon, a carbon compound or a mixture thereof.

136 Claims, 19 Drawing Sheets

OTHER PUBLICATIONS

Thin Solid Films, G. Dittmer, 1972, "Electrical Conduction and Electron Emission of Discontinuous Thin Films", pp. 317–328.*

International Electron Devices, 1975, M. Hartwell et al., "Strong Electron Emission From Patterned Tin–Indium Oxide Thin Films", pp. 519–521.*

Journal of the Vacuum Society of Japan, vol. 26, No. 1, H. Araki et al., "Electroforming and Electron Emission of Carbon Thin Films", pp. 22–29.*

Thin Solid Films, 243, 1994, D.M. Taylor et al., "On the preparation of thin metal oxides by Langmuir–Blodgett film deposition", pp. 384–388.*

Applied Physics Letters, vol. 61, No. 5, Aug. 3, 1992, D.T. Amm et al., Fabrication of ultrathin metal oxide films using Langmuir–Blodgett deposition, pp. 522–524.*

Thin Solid Films, 242, 1994, D.T. Amm et al., "Decomposition of Langmuir–Blodgett films to form metal oxide layers", pp. 74–77.*

"Scanning and Tunneling Microscopic Investigation of Electroformed Planar Metal–Insulator–Metal Diodes," H. Pagnia, N. Sotnik and W. Wirth, Int. J. Electronics, vol. 69, No. 1, 25–32 (1990).*

"Energy Distribution of Emitted Electrons from Electroformed MIM Structures: The Carbon Island Model," M. Bischoff, H. Pagnia and J. Trickl, Int. J. Electronics, vol. 73, No. 5, 1009–1010 (1992).*

"Thin Film Handbook," Committee 131 of Japanese Society for the Promotion of Art and Science.*

"On the Electron Emission from Evaporated Thin Au Films," M. Bischoff, R. Holzer and H. Pagnia, Physics Letters, vol. 62A, No. 7 (Oct. 3, 1977).*

"The Electroforming Process in MIM Diodes," vol. 85, R. Blessing, H. Pagnia and N. Sotnik, Thin Solid Films, 119–128 (1981).*

"Evidence for the Contribution of an Adsorbate to the Voltage–Controlled Negative Resistance of Gold Island Film Diodes," R. Blessing, H. Pagnia and R. Schmitt, Thin Solid Films, vol. 78, 397–401 (1981).*

"Water–Influenced Switching in Discontinuous Au Film Diodes," R. Muller and H. Pagnia, Materials Letters, vol. 2, No. 4A, 283–285 (Mar. 1984).*

"Influence of Organic Molecules on the Current–Voltage Characteristic of Planar MINM Diodes," H. Pagnia, N. Sotnik and H. Strauss, Phy. Stat. Sol., vol. 90, 771–778 (1985).*

"Influence of Gas Composition on Regeneration in Metal/Insulator/Metal Diodes," M. Borbonus, H. Pagnia and N. Sotnik, Thin Solid Films, vol. 151, 333–342 (1987).*

"Prospects for Metal/Non–Metal Microsystems: Sensors, Sources and Switches," H. Pagnia, Int. J. Electronics, vol. 73, No. 5, 319–825 (1992).*

"Carbon–nanoslit Model for the Electroforming Process in MIM Strucutres," M. Bischoff, Int. J. Electronics, vol. 70, No. 3, 491–498 (1991).*

"Metal Influence on Switching MIM Diodes", H. Pagnia et al., phys. stat. sol. (a) 111,387 (1989).*

* cited by examiner

ELECTRON-EMITTING DEVICE, ELECTRON SOURCE AND IMAGE-FORMING APPARATUS

BACKGROUND OF THE INVENTION

1. Field of the Invention

This invention relates to an electron-emitting device, an electron source and an image-forming apparatus comprising such an electron source. It also relates to a method of manufacturing such an electron-emitting device, an electron source and an image-forming apparatus.

2. Related Background Art

There have been known two types of electron-emitting device; the thermoelectron emission type and the cold cathode electron emission type. Of these, the cold cathode emission type refers to devices including field emission type (hereinafter referred to as the FE type) devices, metal/insulation layer/metal type (hereinafter referred to as the MIM type) electron-emitting devices and surface conduction electron-emitting devices. Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5284 (1976).

Examples of MIM device are disclosed in papers including C. A. Mead, "The tunnel-emission amplifier", J. Appl. Phys., 32, 646 (1961).

Examples of surface conduction electron-emitting device include one proposed by M. I. Elinson, Radio Eng. Electron Phys., 10 (1965).

A surface conduction electron-emitting device is realized by utilizing the phenomenon that electrons are emitted out of a small thin film formed on a substrate when an electric current is forced to flow in parallel with the film surface.

While Elinson proposes the use of $SnO_2$ thin film for a device of this type, the use of Au thin film is proposed in [G. Dittmer: "Thin Solid Films", 9, 317 (1972)] whereas the use of $In_2O_3/SnO_2$ and that of carbon thin film are discussed respectively in [M. Hartwell and C. G. Fonstad: "IEEE Trans. ED Conf.", 519 (1975)] and [H. Araki et al.: "Vacuum", Vol. 26, No. 1, p. 22 (1983)].

A surface conduction electron-emitting device is typically prepared by arranging a pair of device electrodes on a substrate, bridging the device electrode by means of an electroconductive film made of metal or a metal oxide and then electrically treating the electroconductive film by subjecting it to a current conduction process referred to as "energization forming" in order to produce an electron-emitting region. In the energization forming process, a constant DC voltage or a slowly rising DC voltage that rises typically at a rate of 1 V/min. is applied to the opposite ends of the electroconductive thin film to partly destroy, deform or transform the film and produce an electron-emitting region which is electrically highly resistive. The electron-emitting region is part of the electroconductive film where one or more than one fissures are formed so that electrons may be emitted therefrom.

Since a surface conduction electron-emitting device as described above has a particularly simple structure and can be manufactured in a simple manner, a large number of such devices can advantageously be arranged on a large area without difficulty. As a matter of fact, a number of studies have been made to fully exploit this advantage of surface conduction electron-emitting devices. For example, there have been proposed various types of image forming apparatus including display apparatus.

Examples of the arrangement of a large number of surface conduction electron-emitting devices include electron sources realized by arranging surface conduction electron-emitting devices to form a number of parallel rows of devices and connecting the opposite ends (device electrodes) of the devices of each row to respective wires (also referred to as common wires) (an arrangement often referred to as radder-like arrangement). (See Japanese Patent Application Laid-Open Nos. 1-31332, 1-213749 and 2-257552.) As for display apparatus, there has been proposed a flat panel display apparatus that is similar to a display apparatus utilizing liquid crystal but of an emission type that does not require the use of a back light. Such a display apparatus can be realized by combining an electron source comprising a large number of surface conduction electron-emitting devices and a fluorescent body that emits visible light when irradiated with electron beams by the electron source. (See U.S. Pat. No. 5,066,883.)

However, known electron-emitting devices to be used for electron sources and image-forming apparatus need to be improved in terms of the efficiency of electron emission and other electron-emitting characteristics to provide image-forming apparatus that can stably produce clear and bright images. The efficiency of electron emission is described in terms of the ratio of the electric current running through the surface conduction electron-emitting device (device current If) to the electric current generated by electrons emitted into vacuum from the device (emission current Ie) when a voltage is applied to the paired device electrodes and it is preferable that the device current is held as small as possible whereas the emission current is made as large as possible. If stably controllable electron emitting characteristics and an improved efficiency of electron emission are achieved for a surface conduction electron-emitting device, an image-forming apparatus comprising an image-forming member of a fluorescent body that produces high quality images at a low power consumption rate can be realized by using such devices. Such an image-forming apparatus may be a flat television set and the drive circuit and other components of such an image-forming apparatus may be manufactured at low cost.

Known electron-emitting devices are, however, not satisfactory in terms of stable electron-emitting characteristics and electron-emitting efficiency and hence the stability of operation of an image-forming apparatus comprising such electron-emitting devices is also unsatisfactory.

Therefore, there is a demand for an electron-emitting device that shows excellent electron-emitting characteristics for a prolonged period of time.

SUMMARY OF THE INVENTION

As a result of a series of intensive research efforts on the part of the inventor of the present invention, it has been found that one of the major causes of degradation of the electron-emitting characteristics of surface conduction electron-emitting device is changes in the electroconductive film of the device as it is driven for operation. As described above, the surface conduction electron-emitting device is a cold cathode type electron-emitting device and a relatively large current If flows through the electroconductive film to generate heat at and near the electron-emitting region and raise the temperature thereof as a voltage is applied to the device to drive it to operate. Therefore, it may be safe to assume that the electroconductive film is locally molten and subsequently coagulated by the heat generated at and near the electron-emitting region as the device is driven to operate for a long period of time.

In order to suppress the degradation of a surface conduction electron-emitting device and prolong its service life, the electroconductive film is desirably made of a material that has a high melting point and, at the same time, a low vapor pressure.

However, on the other hand, the use of a high melting point material for the electroconductive film entails a large power consumption in the process of forming an electron-emitting region (energization forming) described above and can result in poor electron-emitting characteristics of the produced surface conduction electron-emitting device.

Additionally, a tremendous amount of power has to be consumed for the process of energization forming when it is conducted simultaneously on a plurality of surface conduction electron-emitting devices arranged on a substrate and connected to common wires in order to produce a display appratus. Then, wires having a large current capacity have to be selected for it to accommodate such a large power. Still additionally, the voltage applied to the wires shows a remarkable fall due to the electric resistance of the wires and consequently varied effective voltages would be applied to the devices to make it difficult to uniformly carry out the process of energization forming.

If all the above identified problems are cleared by some means and a high melting point metal such as W, Mo, Nb or Ir is used for the electroconductive film, there still remains a problem that any of such metals has a relatively large work function, which is disadvantageous for achieving a large emission current.

Thus, there still exists a demand for electroconductive film that does not consume a large power for energization forming, hardly melts and coagulates locally if heated and provides a large emission current.

In view of the above identified problems, it is therefore an object of the present invention to provide a surface conduction electron-emitting device that shows excellent electron-emitting characteristics for a prolonged period of time, an electron source comprising such devices and an image-forming apparatus having such an electron source. Another object of the invention is to provide a method of manufacturing such a surface conduction electron-emitting, an electron source and an image-forming apparatus.

According to a first aspect of the invention, there is provided an electron-emitting device comprising a pair of oppositely disposed device electrodes and an electroconductive film electrically connecting the device electrodes and having an electron-emitting region as part thereof, characterized in that the electroconductive film is partly or entirely covered by a metal oxide coat containing as principal ingredient a metal oxide different from the material of the electroconductive film and the metal oxide, or the principal ingredient of the metal oxide layer, has a work function lower than that of and a melting point higher than that of the principal ingredient of the electroconductive film.

Preferably, said metal oxide is arranged on the electroconductive film as a layer having a thickness between 1 and 20 nm.

Alternatively, said metal oxide may be arranged on the electroconductive film to fill the voids of the electroconductive film by an amount of 10 to 50% of the volume of the electroconductive.

Preferably, said metal oxide coat contains carbonate of the metal as an auxiliary ingredient.

Preferably, said metal oxide shows a vapor pressure of $1.3\times10^{-3}$ Pa at a higher temperature than the principal ingredient of said electroconductive film.

According to a second aspect of the invention, there is provided an electron source comprising electron-emitting devices according to the first aspect of the invention and means for driving the same.

Preferably, said electron source has one or more than one device rows, each comprising a plurality of electron-emitting devices connected in parallel.

Alternatively, said electron source has a plurality of device rows, each comprising a plurality of mutually connected electron-emitting devices, said devices being arranged in the form of a matrix.

According to a third aspect of the invention, there is provided an image-forming apparatus comprising an electron source according to the invention and an image-forming member designed to produce an image when irradiated with electron beams emitted from the electron source.

Preferably, said image-forming member is a fluorescent body.

According to a fourth aspect of the invention, there is provided a method of manufacturing an electron-emitting device, an electron source and an image-forming apparatus according respectively to the first through third aspects of the invention, characterized in that the step of forming a metal oxide coat for covering an electroconductive film includes a step of applying a metal alkoxide containing solution to form a thin film of the metal alkoxide and a step of pyrolyzing the metal alkoxide to form a metal oxide coat.

According to a fifth aspect of the invention, there is provided a method of manufacturing an electron-emitting device, an electron source and an image-forming apparatus according respectively to the first through third aspects of the invention, characterized in that the step of forming a metal oxide coat for covering an electroconductive film includes a step of forming a monomolecular built-up film of a metal salt of fatty acid or a long chain amine metal complex and a step of pyrolyzing said monomolecular built-up film to form an oxide coat.

DESCRIPTION OF THE PREFERRED EMBODIMENTS

A surface conduction electron-emitting device according to the invention may be either of a plane type or of a step type.

Firstly, a surface conduction electron-emitting device of a plane type will be described.

Figure 1A:
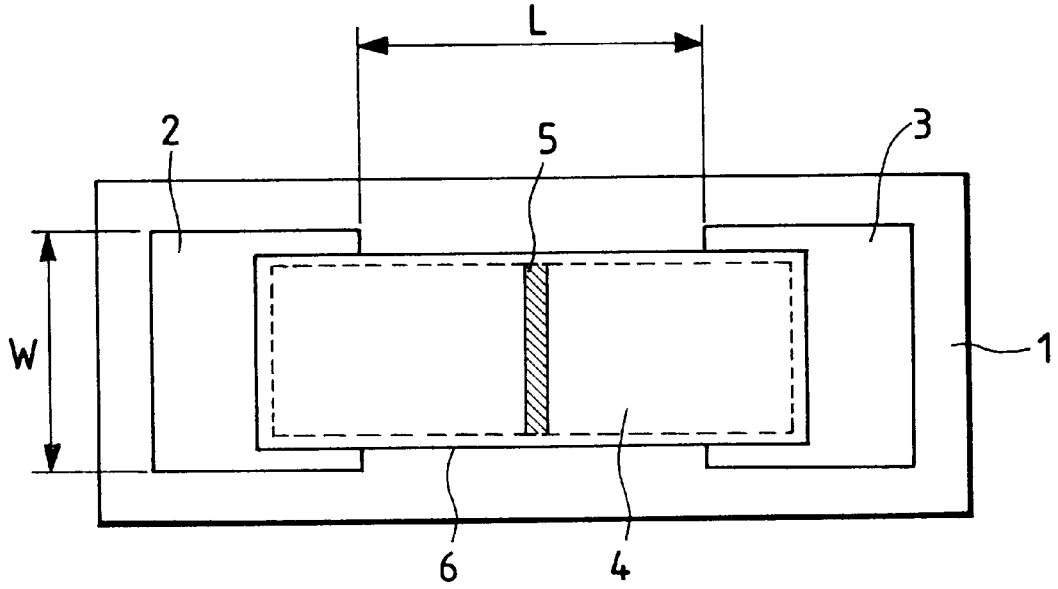
FIGS. 1A and 1B are a plan view and a sectional view schematically illustrating a plane type electron-emitting device according to the invention.
Figure 1B:
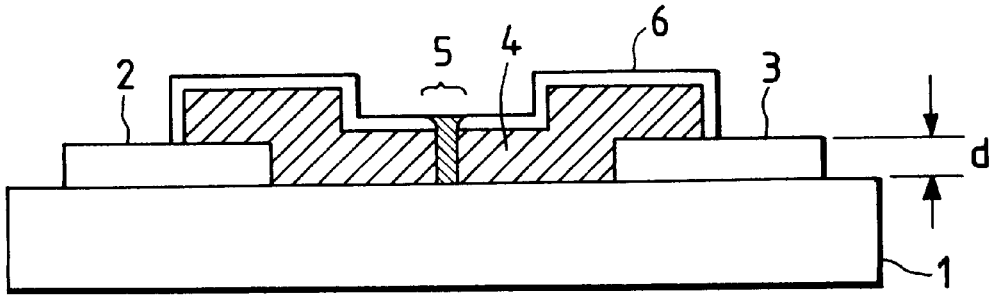

FIGS. 1A and 1B are a schematic plan view and a schematic cross sectional view of a plane type surface conduction electron-emitting device according to the invention.

Referring to FIGS. 1A and 1B, the device comprises a substrate 1, a pair of device electrodes 2 and 3, an electroconductive film 4, an electron-emitting region 5 and an oxide coat 6. Note that, in the case of the device of FIGS. 1A and 1B, the oxide coat is a layer formed on the surface of the electroconductive film 4.

As will be described hereinafter, the electron-emitting region 5 of a device according to the invention has a configuration schematically illustrated in one of FIGS. 21A through 21C, although some of the components of the device are omitted in FIGS. 1A, 1B, 3, 4D, 5 and 19.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina as well as Si.

While the oppositely arranged lower and higher potential side device electrodes 4 and 5 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as polysilicon.

The distance L separating the device electrodes, the length W of the device electrodes, the contour of the electroconductive film 4 and other factors for designing a surface conduction electron-emitting device according to the invention may be determined depending on the application of the device. The distance L separating the device electrodes is preferably between hundreds nanometers and hundreds micrometers and, still preferably, between several micrometers and tens of several micrometers.

The length W of the device electrodes is preferably between several micrometers and hundreds of several micrometers depending on the resistance of the electrodes and the electron-emitting characteristics of the device. The film thickness d of the device electrodes 2 and 3 is between tens of several nanometers and several micrometers.

A surface conduction electron-emitting device according to the invention may have a configuration other than the one illustrated in FIGS. 1A and 1B and, alternatively, it may be prepared by sequentially laying an electroconductive film 4, an oxide coat 6 and oppositely disposed device electrodes 2 and 3 on a substrate 1.

The electroconductive film 4 is preferably made of fine particles in order to provide excellent electron-emitting characteristics. The thickness of the electroconductive film 4 is determined as a function of the stepped coverage of the electroconductive film on the device electrodes 2 and 3, the electric resistance between the device electrodes 2 and 3 and the parameters for the forming operation that will be described later as well as other factors and preferably between hundreds of several picometers and hundreds of several nanometers and more preferably between a nanometer and fifty nanometers. The electroconductive film 4 normally shows a sheet resistance Rs between $10^2$ and $10^7 \Omega/\square$. Note that Rs is the resistance defined by $R=Rs(1/w)$, where t, w and 1 are the thickness, the width and the length of a thin film respectively and R is the resistance determined along the longitudinal direction of the thin film. Note that, while the energization forming operation is described in terms of current conduction treatment here, the energization forming operation is not limited thereto and any operation that can produce one or more than one fissures in the electroconductive film to give rise to a region showing a high electric resistance may suitably be used for the purpose of the invention.

For the purpose of the invention, the electroconductive film 4 is preferably made of a material that can give rise to an electron-emitting region with relatively small power so that it may be covered by a coat of a high melting point metal oxide. Electroconductive materials that can be used for the purpose of the invention include Ni, Au, PdO, Pd and Pt.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between hundreds of several picometers and hundreds of several nanometers and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted by several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particle" (ed., Koreo Kinoshita; Kyoritu Publication, Sep. 1, 1986) describes as follows.

"A fine particle as used herein refers to a particle having a diameter somewhere between 2 to 3 $\mu$m and 10 nm and an ultrafine particle as used herein means a particle having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a cluster." (Ibid., p. 195, 11.22–26)

Additionally, "Hayashi's Ultrafine Particle Project" of the New Technology Development Corporation defines an "ultrafine particle" as follows, employing a smaller lower limit for the particle size.

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p. 2, 11.1–4) "A particle smaller than an ultrafine particle and constituted by several to several hundred atoms is referred to as a cluster." (Ibid., p. 2, 11.12–13)

Taking the above general definitions into consideration, the term "a fine particle" as used herein refers to an agglomerate of a large number of atoms and/or molecules having a diameter with a lower limit between hundreds of several picometers and one nanometer and an upper limit of several micrometers.

Of the above listed materials that can be used for the electroconductive film 4, PdO is most suitable because a fine particle film can easily be formed by calcining an organic Pd compound in the atmosphere, it has a relatively low electric conductivity and a wide process margin relative to the film thickness for obtaining the above defined resistance Rs since it is a semiconductor and it can easily be reduced to Pd to reduce the electric resistance of the electroconductive film after forming an electron-emitting region. However, the advantages of the present invention are not limited by the above listed materials including PdO.

The electron-emitting region 5 is formed in part of the electroconductive film 4 and comprises an electrically highly resistive fissure, although its performance is dependent on the thickness, the quality and the material of the electroconductive film 4 and the energization forming process which will be described hereinafter. The electron-emitting region 5 may contain in the inside electroconductive fine particles with a diameter between hundreds of several picometers and tens of several nanometers that may be contain part or all of the elements of the material of the electroconductive film 4. Additionally, the electron-emitting region 5 and neighboring areas of the electroconductive film 4 may contain carbon and/or one or more than one carbon compounds. Still additionally, the electron-emitting region 5 may contain part or all of the elements of the oxide coat 6. Preferably, the electron-emitting region is made of a material having a low work function in order to produce a large emission current.

The metal oxide coat 6 contains one or more than one oxidized metals as principal ingredient and has a melting point higher than the material of the electroconductive film 4. This is to prevent any degradation of the electron-emitting characteristics of the electroconductive film 4 due to being molten by heat and subsequent coagulation of the material of the electroconductive film 4.

Figure 2A:
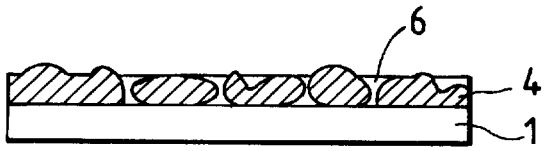
FIGS. 2A through 2C are sectional views illustrating an electroconductive film covered by a metal oxide coat in three different possible modes in an electron-emitting device according to the invention.
Figure 2B:
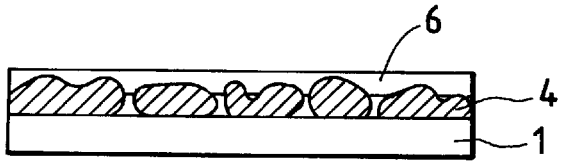
Figure 2C:
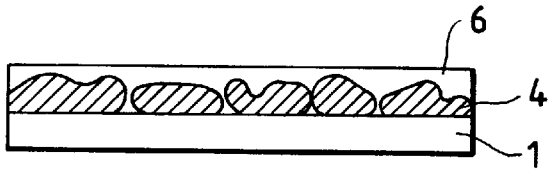

FIGS. 2A through 2C are sectional views illustrating an electroconductive film 4 covered by a metal oxide coat 6 in three different possible modes. A metal oxide coat 6 may be formed in the voids among the fine particles of the electroconductive film 4 as shown in FIG. 2A. Alternatively, a metal oxide coat 6 may be a thin film formed on the electroconductive film as shown in FIG. 2B. Still alternatively, a metal oxide coat 6 may be a layer completely covering the fine particles of the electroconductive film 4 as shown in FIG. 2C. Note that all the three modes of forming an metal oxide coat are effective for the purpose of the invention.

According to the invention, since the electroconductive film 4 is covered by a metal oxide coat 6 having a high melting point, the electroconductive film is prevented from being molten by heat and subsequently coagulated in areas close to the electron-emitting region when the electron-emitting device is driven to operate so that the device can operate to emit electrons stably for a prolonged period of time.

When the metal oxide coat 6 is formed in voids among the fine particles of the electroconductive film 4 as shown in FIG. 2A, the mole percentage of the metallic elements contained in the metal oxide coat relative to the metal contained in the electroconductive film is preferably not higher than 50%. If the mole percentage is greater than 50%, the electroconductivity of the electroconductive film 4 may be damaged and the energization forming operation may require a large power. The mole percentage is preferably not smaller than 10% because, if it is smaller than 10%, on the other hand, the possible degradation of the electron-emitting characteristics of the electroconductive film due to being molten by heat and subsequent coagulation may not be satisfactorily suppressed.

When the metal oxide coat is a thin film formed on the electroconductive film 4 as shown in FIG. 2B, the thin film preferably has a film thickness not greater than 20 nm. If the metal oxide coat has a thickness exceeding the above value, it can be electrically over-charged to change the equipotential surface of the device and its vicinity when the device is driven to operate and eventually discharge the electric load to damage the device. If the energization forming process is conducted after forming the metal oxide coat, the power required for the process can become too large to consequently produce unsatisfactory electron-emitting characteristics for the device and the process may not be successfully completed. Additionally, if the electroconductive film is formed from an electroconductive oxide and then chemically reduced by means of reducing gas to lower the electric resistance of the electroconductive film, the reducing process may not proceed satisfactory.

The film thickness is preferably not smaller than 1 nm because, if the film thickness undergoes the above level, on the other hand, the possible degradation of the electron-emitting characteristics of the electroconductive film due to thermal fusion and subsequent coagulation may not be satisfactorily suppressed.

When the metal oxide coat 6 is a layer completely covering the fine particles of the electroconductive film 4 as shown in FIG. 2C, appropriate values may be selected for the metal oxide coat so long as the above two requirements are met. Preferably, the metal oxide coat has a thickness of 5 nm and occupy the voids of the electroconductive film 4 by about 30%.

Although not shown in FIGS. 2A through 2C, when a metal oxide coat is formed on the electron-emitting region 5, a large emission current can be achieved with a low drive voltage by selecting a metal oxide having a low work function for the coat.

The work function of the metal oxide coat affects the performance of the electron-emitting device in many other ways.

Figure 6:
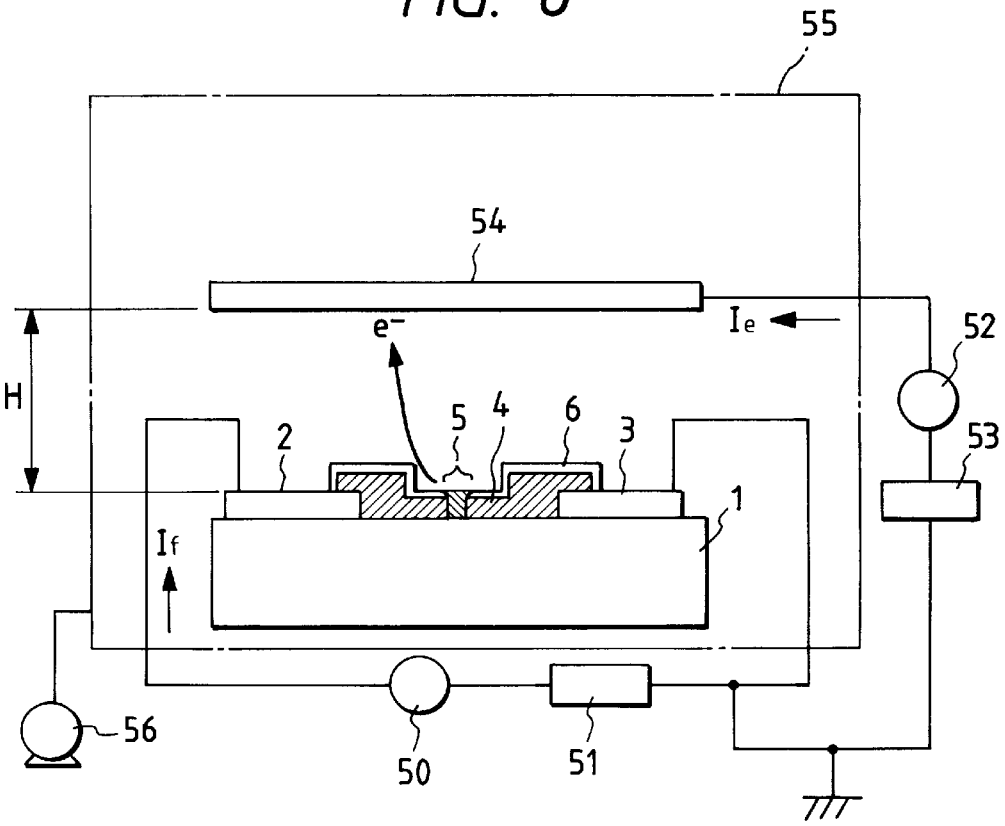
FIG. 6 is a schematic illustration of a gauging system to be used to evaluate the performance of an electron-emitting device according to the invention.
Figure 19:
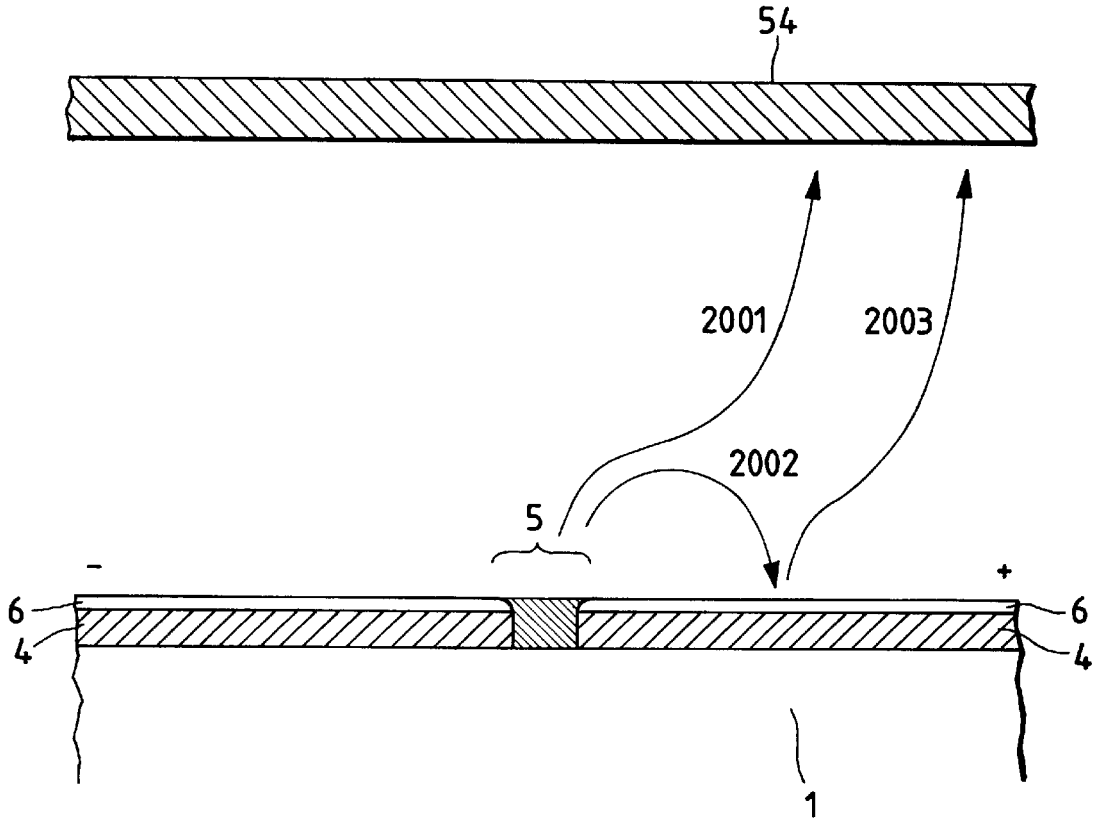
FIG. 19 is a schematic partial sectional view of an image-forming apparatus according to the invention, illustrating possible trajectories of emitted electrons.

For driving an electron-emitting device to emit electrons, an anode 54 is arranged to the upstream of the electron-emitting device as shown in FIG. 6 and a high voltage is applied to the electron-emitting device by way of the anode. Then, a complex equipotential surface appears around the electron-emitting region due to the low and high potential sides of the electroconductive film 4 and the anode 54. As schematically shown in FIG. 19, some of the electrons emitted from the electron-emitting region 5 leave a trajectory typically indicated by 2001 before they directly get to the anode 54, while the remaining electrons form a trajectory typically indicated by 2002 and strike the high potential side of the electroconductive film 4. Part of the electrons that hit the high potential side of the electroconductive film 4 are elastically reflected and scattered, typically showing a trajectory indicated by 2003 before they get to the anode 54, while the others are absorbed by the electroconductive film 4. The electrons that get to the anode are observed as emission current Ie and those that are absorbed by the high potential side of the electroconductive film 4 are observed as part of the device electrode If. For an electron-emitting device to operate efficiently, it preferably shows a large value for the electron-emission efficiency of $\eta$=Ie/If. In order to have a large electron-emitting efficiency, more electrons have to be elastically reflected and scattered out of those that hit the high potential side of the electroconductive film 4, typically showing a trajectory as indicated by 2002. As for an object that elastically reflects and scatters electrons such as an electroconductive film, the electron reflectivity of the object is determined not only by the component elements of the object but also by the work function of the object, which has to be made small to increase the reflectivity. Thus, the probability of being elastically scattered for the electrons emitted from the electron-emitting region will be increased by covering the electroconductive film with a substance having a low work function.

Additionally, the metal oxide to be used for the metal oxide coat 6 is required to show a low vapor pressure. If the metal oxide produces a high vapor pressure, the electron-emitting device will be prevented from operating properly and stably because it is driven to operate in vacuum and the metal oxide coat will be eventually lost as the metal oxide is evaporated gradually. Generally speaking, the metal oxide to be used for the metal oxide coat may be selected from those showing a vapor pressure of about $1.3\times10^{-3}$ Pa ($10^{-5}$ Torr) unless they have a particular temperature-vapor pressure relationship. When Pd (that produces a vapor pressure of $1.3\times10^{-3}$ at 1370K) is used for the electroconductive film 4, metal oxides that can be used for the purpose of the invention include $Al_2O_3$ (2037K), BeO (1995K), $La_2O_3$ (1690K), $TiO_2$ (1919K), $ThO_2$ (1919K), $Y_2O_3$ (2234K), $HfO_2$ (2415K), $ZrO_2$ (2203K), BaO (1459K), CaO (1858K), MgO (1714K), SrO (1687K), FeO (1521K) and $WO_2$ (1783K). (The above oxides are quoted from p.917 of "Thin Film Handbook" (Ohm Publishing Co., Ltd.).)

Of these, BeO, CaO, MgO, $ThO_2$, $Y_2O_3$, $HfO_2$, SrO and $ZrO_2$ are preferably because they have a high melting point and a low work function. Composite oxide containing any of the above metals may also be used effectively for the purpose of the invention. While some of the metal oxides may be unstable in the atmosphere and toxic, such instability and toxicity have nothing to do with the present invention. Therefore, an appropriate material should be selected depending on the environment and the purpose of the use of an electron-emitting device according to the invention. The metal oxide coat may contain the carbonate of the metal, its content should be held below that of the oxide of the metal.

Techniques that can be used to produce a metal oxide coat comprising a metal oxide as defined above for the purpose of the invention include vacuum evaporation (including electron beam evaporation, resistance heating evaporation and laser evaporation), sputtering, chemical vapor deposition (CVD), a method of applying an organic metal compound solution and a method of forming a deposit of a metal compound by the Langmuir-Blodgett technique and pyrolyzing it into the oxide of the metal.

The technique of applying an organic metal compound solution may be carried out in many different ways. For instance, a solution of metal alkoxide may be applied to the substrate by simple means such as dip coating or spin coating. Since metal alkoxide M(OR)x is soluble into an organic solvent and there are a number of alkoxide groups that can be combined with a variety of metals M, this technique can be used to form a variety of metal oxides and the metal alkoxide provides suitable materials for the purpose of the invention.

Since the metal alkoxide is required to be soluble to the solvent, alcohol ROH having a number of carbon atoms same as the alkoxide group is typically used. While most metals can form respective alkoxides, those that are hardly soluble to the solvent or extremely reactive are not suitable for the purpose of the invention. The solubility and reactivity of an alkoxide group can vary depending on the size of the group and many alkoxide groups having a small alkyl group R such as $CH_3$ or $C_2H_5$ are insoluble to the solvent. If a large alkyl group R is involved, on the other hand, the alkoxide group comprising it may show an enhanced solvent-solubility but carbon atoms can remain as impurity in the reaction product after the pyrolysis. In view of the above facts, the isopropyl group ($^i$Pr), the isobutyl group ($^i$Bu), the secondary butyl group ($^s$Bu) and the tertiary butyl group ($^t$Bu) are preferable and the isopropyl group is most preferably for the purpose of the invention.

The above described application technique is particularly advantageous because it can be used to deposit metal oxide without involving the use of a large vacuum system unlike vacuum evaporation, sputtering and CVD.

The Langmuir-Blodgett (LB) technique provides another method for deposing an organic metal compound. With the LB technique, a monomolecular film is formed on water by utilizing the hydrophilicity and the hydrophobicity of both hydrophilic and hydrophobic molecules and then moved onto the surface of a substrate so that a monomolecular built-up film (LB film) can be formed by sequentially laying a number of monomolecular films on the substrate.

Typical film forming molecules that can be used for the purpose of the invention include long chain fatty acids having a hydrophobic group (—$CH_n$—) and a hydrophilic group (—COOH) in the molecule, of which those having 16 to 22 carbon atoms are preferable for forming a monomolecular film on the water/air interface because of the matching reactivities of the hydrophobic group and the hydrophilic group within the molecule. Examples of such long chain fatty acids include palmitic acid $CH_3(CH_2)_{14}COOH$ having sixteen carbon atoms, margaric acid $CH_3(CH_2)_{15}COOH$ having seventeen carbon atoms, stearic acid $CH_3(CH_2)_{16}COOH$ having eighteen carbon atoms, nonadecaic acid $CH_3(CH_2)_{17}COOH$ having nineteen carbon atoms, arachidic acid $CH_3(CH_2)_{18}COOH$ having twenty carbon atoms, heneicosaic acid $CH_3(CH_2)_{19}COOH$ having twenty one carbon atoms and behenic acid $CH_3(CH_2)_{20}COOH$ having twenty two carbon atoms. Typically, a selected one of these fatty acids is dissolved to a volatile solvent such as chloroform or benzene to a concentration of 0.5 to 5.0 mM/liter and caused to fall dropwise on the water surface to give rise to a monomolecular film.

Figure 20A:
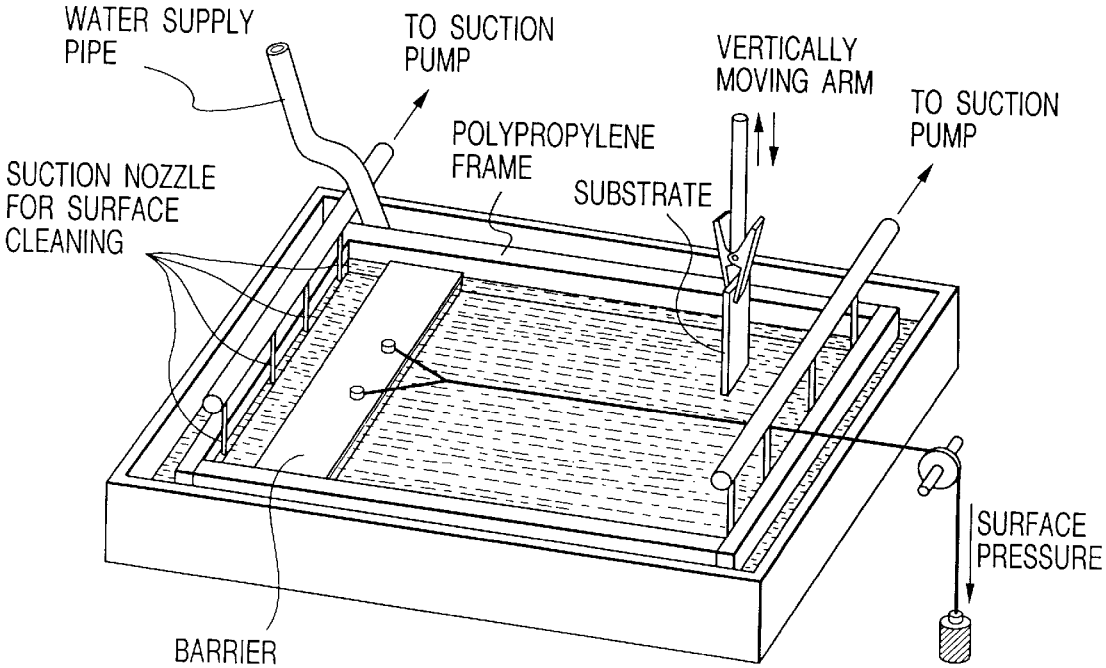
FIGS. 20A and 20B are schematic perspective views of an apparatus for forming LB film for the purpose of the invention.
Figure 20B:
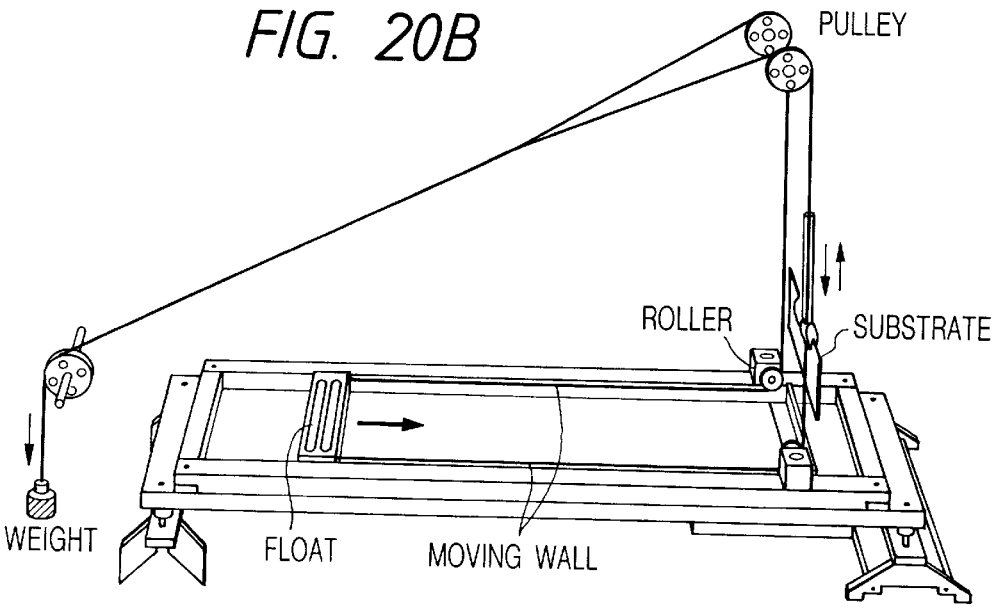

Various metal salts of these fatty acids can also be used for forming a film by means of the LB technique. For forming such a monomolecular film, a fatty acid solution is made to spread on the surface of the underlying water that contains metal ions to a concentration of 0.001 mM/liter to 5.0 mM/liter. While a monomolecular film of the salt of a metal having a relatively large valence, for example the aluminum salt of fatty acid where the aluminum is trivalent, is stable, such a film cannot be produced by an ordinary LB technique because of the film shows an enormous rigidity. If such is the case, a moving wall type (Miyata type) trough will provide a mighty help for forming a film. The ordinary LB technique is typically used with an apparatus as illustrated in FIGS. 20A and 20B, where the substrate is moved vertically to sequentially form monomolecular films thereon. As more films are formed, the float is moved to reduce the developed surface area of the monomolecular film on the water in order to maintain the surface pressure to a constant level. With the moving wall technique, on the other hand, the substrate has a width equal to that of the trough and the peripheral walls of the trough moves to reduce the developed surface area of the monomolecular film on the water as the substrate is moved vertically to pick up the film onto the substrate.

Normally, a metal salt of fatty acid is good for forming monomolecular films when the metal is selected from divalent metals such as Cd, Ca and Ba. An LB film of any of such metal salts of fatty acid can be produced by means of the ordinary LB technique. If a monovalent metal is used, it can form a micelle to eventually dissolved into water.

Compounds that can be used for forming an LB film by the LB technique are not limited to fatty acids so long as they have both a hydrophilic group and a hydrophobic group within a molecule. Examples of compounds that can be used with the LB technique to form a film include long chain amines (such as octadecile amine) having both an hydrophobic group (—$CH_n$—) and a hydrophilic group (—$NH_2$—) and polymers (e.g., polyimides) having both a hydrophobic group and a hydrophilic group that show matching reactivities. If such an organic compound maintains its hydrophobicity and hydrophilicity when it is made to contain a metal in the form of salt or complex, a film of the oxide of the metal can be produced by sequentially forming monomolecular films of the organic compound that contains the metal and pyrolyzing the obtained built-up film as the hydrocarbon is decomposed and volatilized. Amm et al. produced yttrium oxide and cadmium oxide by forming built-up films of yttrium arachidate and cadmium arachidate and pyrolyzing the respective films [D. T. Amm, D. J. Johnson, T. Laursen and S. K. Gupta. Appl. Phys. Lett. 61,522, (1992) and D. T. Amm, D. J. Johnson, N. Matsuura, T. Laursen and G. Palmer, Thin Solid Films, 242,74, (1994)]. Taylor and et al. synthetically produced zinc oxide by pyrolyzing a built-up film of zinc stearate [D. M. Taylor and J. N. Lambi, Thin Solid Films, 243,384, (1994)].

According to the invention, a metal oxide coat 6 is formed on an electroconductive film 4 by applying the above method of synthetically producing oxides of metals. More specifically, a desired number of monomolecular films of a metal salt of fatty acid or a long chain amine/metal complex are sequentially laid on a substrate and then pyrolyzed to produce a metal oxide layer having a desired film thickness. This method is particularly advantageous to accurately controlling the film thickness of the metal oxide layer.

For using the LB technique, care should be taken to control the pH value of the underlying water on which a monomolecular film is spread and the pH regulating agent (buffer solution) to be used with it. The formation of a metal salt of fatty acid is heavily dependent on the pH value of the reaction system and the latter varies depending on the metal involved. A low ratio of the total number of molecules of the developed fatty acid to the number of molecules that have formed the metal salt is not favorable because, the lower the ratio, the lower is the concentration of the metal in the built-up film and hence that of the formed metal oxide. The pH value of the underlying water should be selected depending on the involved metal. While phosphate, borate and carbonate are popularly used for buffer solutions, the use of a buffer solution that does not contain any metal is preferable for the purpose of the invention because, if it does contain metal, the metal and the developed fatty acid easily and undesirably react with each other to produce a metal salt. Additionally, the use of an organic compound type buffer solution is preferable in order to avoid the generation of corrosive gas after the pyrolysis. Organic compounds that are preferably used for the purpose of the invention include tri(hydroxymethyl)aminomethane, glycine and acetic acid, although other compounds that do not adversely affect the pyrolysis may also be used. The process of producing a metal oxide coat on a substrate carrying thereon an electroconductive film 4 specifically proceeds as follows.

Firstly, the substrate on which an electroconductive film 4 has been formed is preliminarily treated for hydrophobicity before forming an LB film. While known techniques for treating the surface of a substrate for hydrophobicity include the vapor phase adsorption technique involving the use of hexamethyldisilazane and the technique of forming a single layer of octadecileamine film by means of the LB method, any other appropriate techniques for treating the surface of a substrate for hydrophobicity may also be used for the purpose of the invention. If the substrate is significantly stained, the stain may have to be removed typically by means of a UV/$O_3$ treatment that is popularly used in the semiconductor process to make it hydrophilic in advance. Then, layers of a metals salt of fatty acid or those of a long chain mine/metal complex are formed on the preliminarily treated substrate is by means of the LB technique. As described above, fatty acids that can be used for the purpose of the invention include those having 16 to 22 carbon atoms. Long chain amines that can be used for the purpose of the invention include their isomers. Metal compounds that can be used for the purpose of the present invention include chlorides and acetates of Mg, Ca, Ba, Y, Al and Ti. The concentration of the dissolved metal is typically between 0.01 mM/liter and 10 mM/liter. As described above, the pH value of the underlying water have to be regulated by means of an appropriate buffer solution in order to accelerate the formation of a metal salt. The obtained built-up film of the metal salt of fatty acid is then thermally treated at 300 to 600° C. for 20 to 60 minutes in the atmosphere to produce a metal oxide coat 6.

On the other hand, most of the above listed high melting point metal oxides are electrically insulating. When the electroconductive film 4 and the electron-emitting region 5 are covered by a considerably thick electrically insulating metal oxide film, it can obstruct the emission of electrons from the electron-emitting region to adversely affect the performance of the electron-emitting device. Additionally, as described earlier, the electroconductive film can be electrically overcharged by electronrons emitted from the electron-emitting region and striking the film to give rise to problems during the operation of the device.

The metal oxide may be made electroconductive by doping it with alkaline metal or alkaline earth metal but such induced electroconductivity can become unstable when it is exposed to high temperature in vacuum.

If an electroconductive metal oxide is used, the electroconductivity of the produced metal oxide coat can become unnegligible relative to the electroconductivity of the electroconductive film to consequently consume large power for the process of energization forming.

In view of the above problems, the metal oxide coat 6 may well have a thickness between 1 nm and 20 nm if it is electrically insulating. If the thickness is found within the above defined range, the metal oxide coat does not adversely affect the operation of the electron-emitting device and operates effectively to suppress any possible degradation of the performance of the device. It should be noted, however, that the above cited parameters are not necessarily absolute and may be modified depending on the form and the density of the metal oxide and other conditions.

Now, a step type electron-emitting device will be described below.

Figure 3:
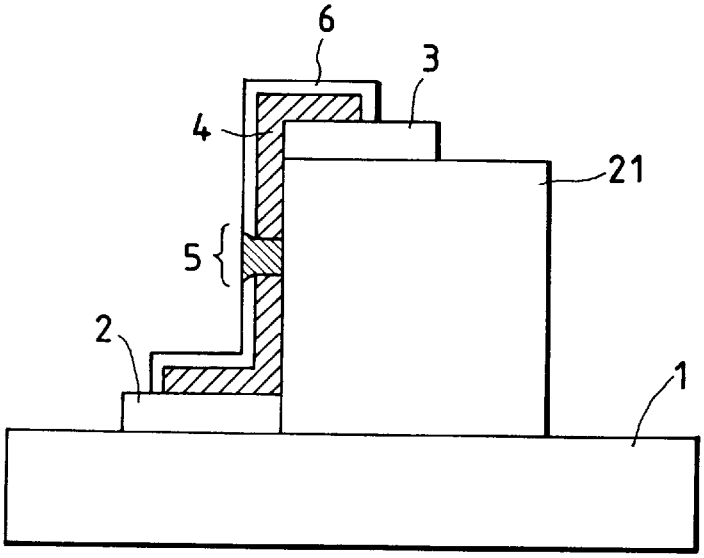
FIG. 3 is a sectional view schematically illustrating a step type electron-emitting device according to the invention.

FIG. 3 is a schematic cross sectional view of a step type electron-emitting device according to the invention.

In FIG. 3, the components that are same as or similar to those of the device of FIGS. 1A and 1B are denoted by the same reference symbols. Reference symbol 21 denotes a step-forming section. The device comprises a substrate 1, device electrodes 2 and 3, electroconductive thin film 4 and an electron emitting region 5, which are made of materials same as a flat type surface conduction electron-emitting device as described above, as well as a step-forming section 21 made of an insulating material such as $SiO_2$ produced by vacuum deposition, printing or sputtering and having a height corresponding to the distance L separating the device electrodes of a flat type surface conduction electron-emitting device as described above, or between several hundred nanometers and tens of several micrometers. Preferably, the height of the step-forming section 21 is between tens of several nanometers and several micrometers, although it is selected as a function of the method of producing the step-forming section used there and the voltage to be applied to the device electrodes.

After forming the device electrodes 2 and 3 and the step-forming section 21, the electroconductive thin film 4 is laid on the device electrodes 2 and 3. While the electron-emitting region 5 is formed on the step-forming section 21 in FIG. 3, its location and contour are dependent on the conditions under which it is prepared, the energization forming conditions and other related conditions are not limited to those shown there.

While various methods may be conceivable for manufacturing a surface conduction electron-emitting device having a configuration illustrated in FIGS. 1A and 1B. FIGS. 4A through 4D schematically illustrate a typical one of such methods. Note that, in FIGS. 4A through 4D, the components that are same as or similar to those of the device of FIGS. 1A and 1B are denoted by the same reference symbols.

Figure 4A:
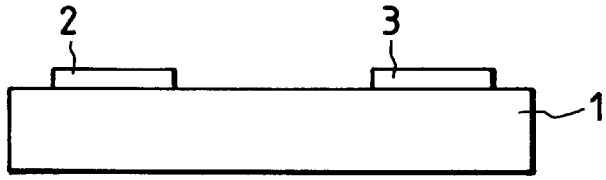
FIGS. 4A through 4D are sectional views of the electron-emitting device of FIGS. 1A and 1B illustrating different manufacturing steps.

1) After thoroughly cleansing a substrate 1 with detergent, pure water and organic solvent, a material is deposited on the substrate 1 by means of vacuum deposition, sputtering or some other appropriate technique for a pair of device electrodes 2 and 3, which are then produced by photolithography (FIG. 4A).

Figure 4B:
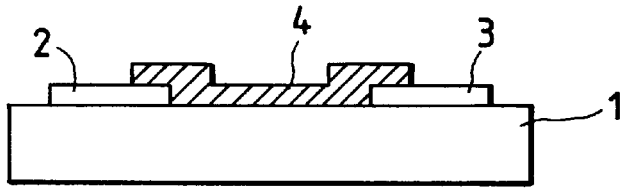

2) An organic metal thin film is formed on the substrate 1 that carries thereon the pair of device electrodes 2 and 3 by applying an organic metal solution and leaving the applied solution for a given period of time. The organic metal solution may contain as principal ingredient any of the metals listed earlier for the electroconductive thin film 4. Thereafter, the organic metal thin film is heated, calcined and subsequently subjected to a patterning operation, using an appropriate technique such as lift-off or etching, to produce an electroconductive thin film 4 (FIG. 4B). While an organic metal solution is used to produce thin films in the above description, an electroconductive thin film 4 may alternatively be formed by vacuum deposition, sputtering, chemical vapor phase deposition (CVD), dispersed application, dipping, spinner or some other technique.

Figure 4C:
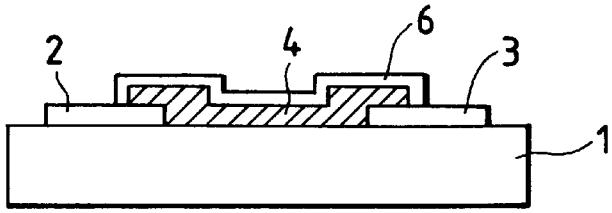

3) Then, a metal oxide coat 6 is formed on the substrate 1 that carriers thereon the electroconductive film 4 by means of electron beam evaporation, using a metal oxide having a melting point higher than that of the material of the electroconductive film 4 as the material to be evaporated (FIG. 4C). While the metal oxide is the principal ingredient of the formed metal oxide coat 6, the latter may additionally contain the metal carbonate or hydroxide as part of it. Note that, however, such metal carbonate or hydroxide that may be used for the purpose of the invention does not provide any problem because, when heated, it is changed to the corresponding oxide and the melting point (or sublimating point) of the oxide is important for the operation of the prepared electron-emitting device. For the purpose of the invention, the metal oxide coat 6 may well cover or be contained in the electroconductive film 4 and does not need to be specifically patterned unless it is highly electroconductive, although it may be formed with the electroconductive film 4 before the latter is subjected to a patterning operation described above for the second processing step so that both the electroconductive film 4 and the metal oxide coat 6 may be patterned simultaneously and appropriately. It may be needless to say that any areas of the device to be used for electrically connecting the device electrodes 2 and 3 and a power source or a drive circuit (not shown) should not be covered by the metal oxide coat 6.

The technique to be used for forming the metal oxide coat 6 is not limited to electron beam evaporation and may be selected from other techniques including vacuum evaporation, sputtering and CVD. In the case of manufacturing an electron source having a large surface area, a film of an organic metal compound may be formed by applying the solution of the compound or by means of the LB technique and subsequently heat-treating the solution. Note that the metal oxide coat 6 may be formed after the energization forming process as will be described hereinafter by using a material and processing procedures that are selected appropriately.

4) Subsequently, the device is subjected to a process referred to as "energization forming". While energization forming is described below in terms of current conduction treatment, any appropriate technique for forming a gap in the electroconductive film 4 to produce an electrically highly resistive condition may alternatively be used for the energization forming process for the purpose of the invention.

Figure 4D:
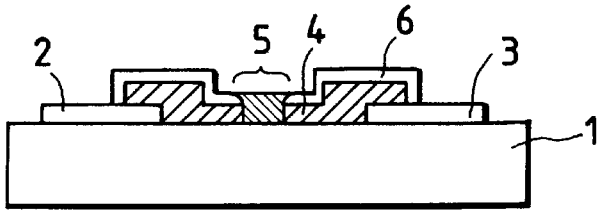

An electric current is conducted between the device electrodes 2 and 3 by means of a power source (not shown) to produce an electron-emitting region 5 in the electroconductive film by structuring modifying the latter (FIG. 4D). As a result of energization forming, part of the electroconductive thin film 3 is locally destroyed, deformed or transformed to make an electron-emitting region 5. If a metal oxide coat 6 is formed before the energization forming process, it may also be locally destroyed, deformed or transformed.

Figure 5A:
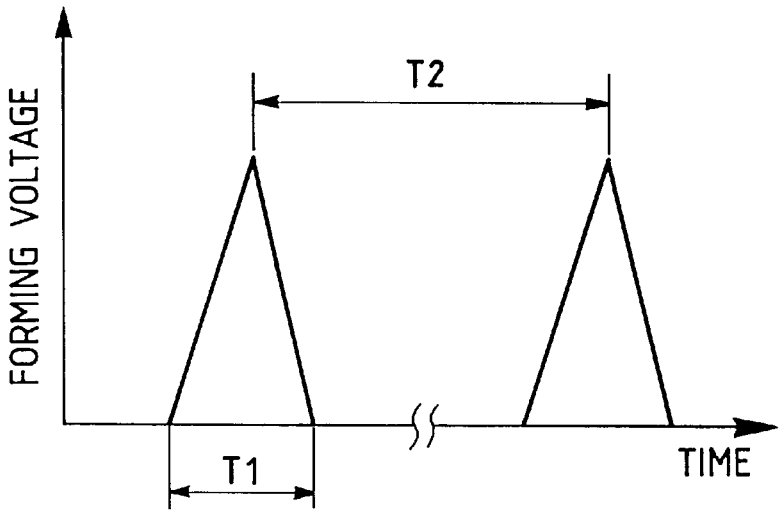
FIGS. 5A through 5C are graphs illustrating the waveforms of three different voltage pulses that can be used for energization forming for the purpose of the invention.
Figure 5B:
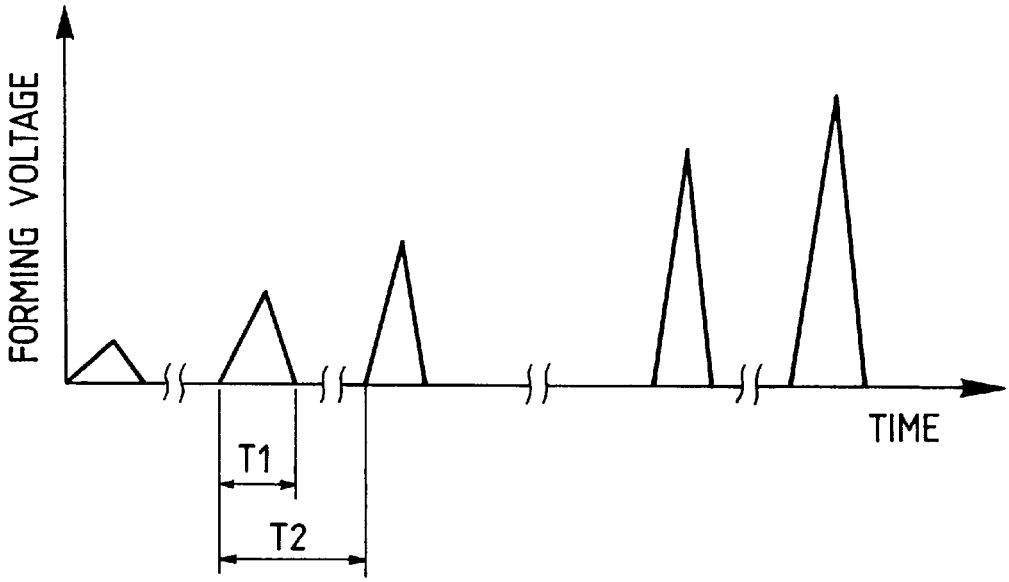

Voltage waveforms that can be used for energization forming are shown in FIGS. 5A and 5B.

The voltage to be used for energization forming preferably has a pulse waveform. A pulse voltage having a constant height or a constant peak voltage may be applied continuously as shown in FIG. 5A or, alternatively, a pulse voltage having an increasing wave height or an increasing peak voltage may be applied as shown in FIG. 5B.

In FIG. 5A, the pulse voltage has a pulse width T1 and a pulse interval T2, which are typically between 1 $\mu$sec. and 10 msec. and between 10 $\mu$sec. and 100 msec. respectively. The height of the triangular wave (the peak voltage for the energization forming operation) may be appropriately selected depending on the profile of the surface conduction electron-emitting device. Such a voltage is applied to the device electrodes for several seconds to tens of several minutes typically in vacuum of a degree of $1.3\times10^{-3}$ Pa or less. Note that the waveform of the pulse is not necessarily limited to triangle and a rectangular or some other waveform may also be used. Also note that the pulse waveheight, the pulse width and the pulse interval are not limited to the above values and any other appropriate values may alternatively be selected to produce an electron-emitting region in good shape.

FIG. 5B shows a pulse voltage whose pulse height increases with time. In FIG. 5B, the pulse voltage has an width T1 and a pulse interval T2 that are substantially similar to those of FIG. 5A. The height of the triangular wave (the peak voltage for the energization forming operation) is, however, gradually increased.

The energization forming operation will be terminated by measuring the current running through the device electrodes when a voltage that is sufficiently low and cannot locally destroy or deform the electroconductive thin film 4, or about 0.1 V, is applied to the device during an interval T2 of the pulse voltage. Typically the energization forming operation is terminated when a resistance greater than 1M ohms is observed for the device current running through the electroconductive film 3 while applying a voltage of approximately 0.1 V to the device electrodes.

5) Thereafter, the device is subjected to an activation process. An activation process is a process by means of which the device current If and the emission current Ie are changed remarkably.

In an activation process, a pulse voltage may be repeatedly applied to the device in an atmosphere of the gas of an organic substance as in the case of energization forming process. The atmosphere may be produced by utilizing the organic gas remaining in a vacuum chamber after evacuating the chamber by means of an oil diffusion pump or a rotary pump or by sufficiently evacuating a vacuum chamber by means of an ion pump and thereafter introducing the gas of an organic substance into the vacuum. The gas pressure of the organic substance is determined as a function of the profile of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid. As a result of an activation process, carbon or a carbon compound is deposited on the device out of the organic substances existing in the atmosphere to remarkably change the device current If and the emission current Ie.

The order of carrying out the step of forming a metal oxide coat and that of forming a deposited film of carbon or a carbon compound by an activation process may be reversed depending on which layer comes upper on the prepared device.

Since a voltage is applied between the device electrodes in the activation process as described above, coagulation may take place, if slightly, during this process to consequently reduce the emission current Ie if it is conducted before the formation of a metal oxide coat, although such reduction in the emission current is very small. Since the metal oxide coat is located above the deposit of carbon or a carbon compound, on the other hand, the effect of improving the electron emission efficiency can become conspicuous if the metal oxide coat has a low work function. To the contrary, when the activation process comes after the film formation, any slight reduction in the emission current due to the activation process can be effectively prevented.

The time of terminating the activation process is determined appropriately by observing the device current If and the emission current Ie. The pulse width, the pulse interval and the pulse wave height of the pulse voltage to be used for the activation process will be appropriately selected.

For the purpose of the invention, carbon and carbon compounds include graphite (namely HOPG, PG and GE, of which HOPG has a substantially perfect graphite crystalline structure and PG has a somewhat distorted crystalline structure with an average crystal grain size of 20 nanometers, while the crystalline structure of GC is further distorted with an average crystal grain size as small as 2 nanometers) and noncrystalline carbon (refers to amorphous carbon and a mixture of amorphous carbon and fine crystal grains of graphite) and the thickness of the deposited film is preferably less than 50 nanometers, more preferably less than 30 nanometers.

6) An electron-emitting device that has been treated in an energization forming process and an activation process is then preferably subjected to a stabilization process. This is a process for removing any organic substances remaining in the vacuum chamber. The vacuuming and exhausting equipment to be used for this process preferably does not involve the use of oil so that it may not produce any evaporated oil that can adversely affect the performance of the performance of the treated device during the process. Thus, the use of a sorption pump or an ion pump may be a preferable choice.

If an oil diffusion pump or a rotary pump is used for the activation process and the organic gas produced by the oil is also utilized, the partial pressure of the organic gas has to be minimized by any means. The partial pressure of the organic gas in the vacuum chamber is preferably lower than $1.3\times10^{-6}$ Pa and more preferably lower than $1.3\times10^{-8}$ Pa if no carbon or carbon compound is additionally deposited. The vacuum chamber is preferably evacuated after heating the entire chamber so that organic molecules adsorbed by the inner walls of the vacuum chamber and the electron-emitting device in the chamber may also be easily eliminated. While the vacuum chamber is preferably heated to 80° C. or above, preferably to 250° C. or above, for as long as possible, other heating conditions may alternatively be selected depending on the size and the profile of the vacuum chamber and the configuration of the electron-emitting device in the chamber as well as other considerations. The pressure in the vacuum chamber needs to be made as low as possible and it is preferably lower than $1\times10^{-5}$ Pa and more preferably lower than $1.3\times10^{-6}$ Pa, although some other level of pressure may appropriately be selected.

After the stabilization process, the atmosphere for driving the electron-emitting device or the electron source is preferably same as the one when the stabilization process is completed, although a lower pressure may alternatively be used without damaging the stability of operation of the electron-emitting device or the electron source if the organic substances in the chamber are sufficiently removed.

By using such a low pressure atmosphere, the formation of any additional deposit of carbon or a carbon compound can be effectively suppressed and $H_2O$, $O_2$ and other substances that have been adsorbed by the vacuum chamber and the substrate can be effectively removed to consequently stabilize the device current If and the emission current Ie.

The performance of a surface conduction electron-emitting device prepared by way of the above processes will be described below referring to FIGS. 6 and 7A.

FIG. 6 is a schematic block diagram of an arrangement comprising a vacuum chamber that can also be used as a gauging system for determining the performance of an electron emitting device of the type under consideration. Referring to FIG. 6, those components that are similar to or same as those of FIGS. 1A and 1B are denoted by the same reference symbols. The gauging system includes a vacuum chamber 55 and a vacuum pump 56. An electron-emitting device is placed in the vacuum chamber 55. The device comprises a substrate 1, a pair of device electrodes 2 and 3, an electroconductive film 4 and an electron-emitting region 5. Otherwise, the gauging system has a power source 51 for applying a device voltage Vf to the device, an ammeter 50 for metering the device current If running through the electroconductive film 4 between the device electrodes 2 and 3, an anode 54 for capturing the emission current Ie produced by electrons emitted from the electron-emitting region of the device, a high voltage source 53 for applying a voltage to the anode 54 of the gauging system and another ammeter 52 for metering the emission current Ie produced by electrons emitted from the electron-emitting region 5 of the device. For determining the performance of the electron-emitting device, a voltage between 1 and 10 KV may be applied to the anode, which is spaced apart from the electron emitting device by distance H which is between 2 and 8 mm.

The surface conduction electron-emitting device and the anode 54 and other components are arranged in the vacuum chamber 55, which is equipped with a vacuum gauge and other necessary instruments so that the performance of the electron-emitting device in the chamber may be properly tested in vacuum of a desired degree. The vacuum pump 56 may be provided with an ordinary high vacuum system comprising a turbo pump or a rotary pump an ultra-high vacuum system comprising an ion pump. The entire vacuum chamber 55 and the substrate of an electron-emitting device contained therein can be heated by means of a heater (not shown). Thus, this vacuum processing arrangement can be used for an energization forming process and the subsequent processes.

Figure 7A:
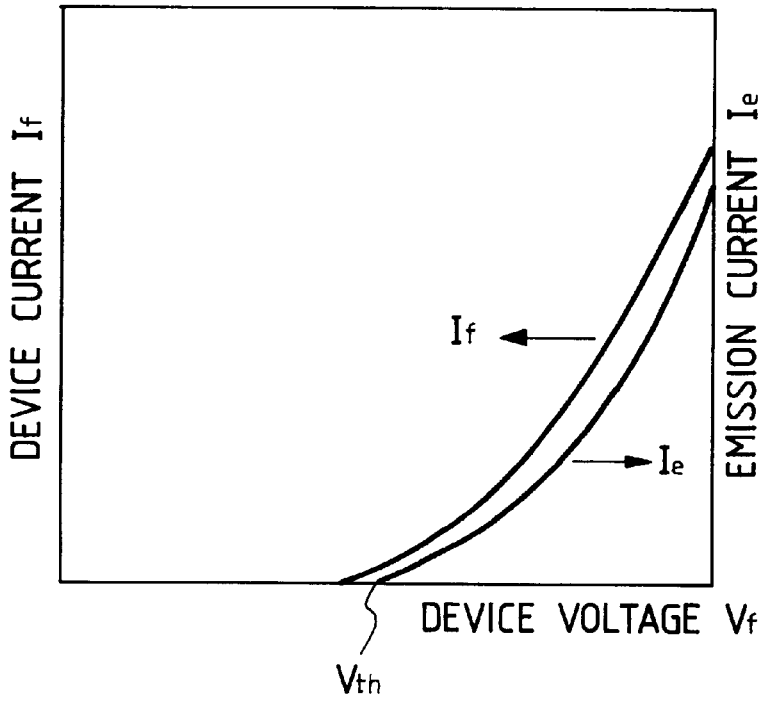
FIGS. 7A and 7B are graphs illustrating two different possible relationships between the device voltage Vf and the device current If along with the relationship between the device voltage Vf and the emission current Ie of an electron-emitting device according to the invention.
Figure 7B:
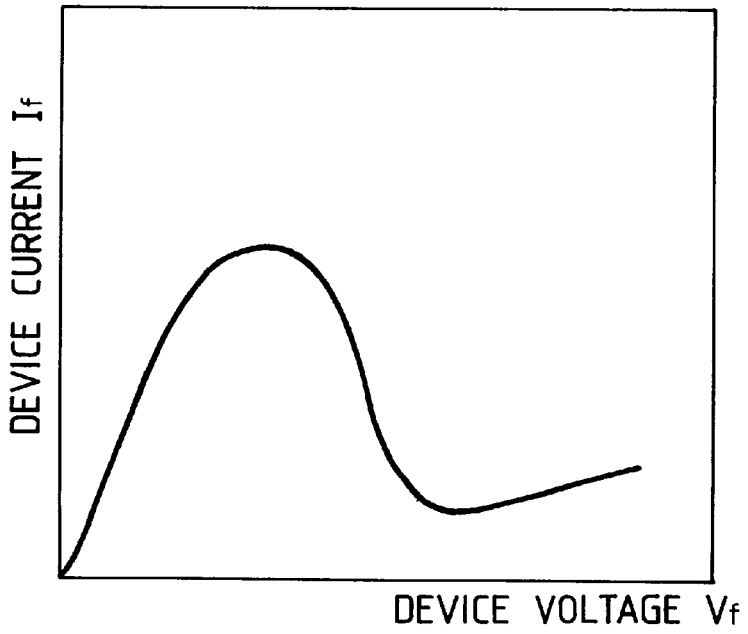

FIG. 7A shows a graph schematically illustrating the relationship between the device voltage Vf and the emission current Ie and the device current If typically observed by the gauging system of FIG. 6. Note that different units are arbitrarily selected for Ie and If in FIG. 7A in view of the fact that Ie has a magnitude by far smaller than that of If. Note that both the vertical and transversal axes of the graph represent a linear scale.

As seen in FIG. 7A, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 7A), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent on the device voltage Vf, the former can be effectively controlled by way of the latter.

(iii) Thirdly, the emitted electric charge captured by the anode 54 is a function of the duration of time of application of the device voltage Vf. In other words, the amount of electric charge captured by the anode 54 can be effectively controlled by way of the time during which the device voltage Vf is applied.

Because of the above remarkable features, it will be understood that an electron-emitting device according to the invention can be easily controlled for its electron-emitting performance as a function of input signal. Therefore, such an electron-emitting device may various applications including an electron source realized by arranging a plurality of electron-emitting devices and an image-forming apparatus comprising such an electron source.

The device current If either monotonically increases relative to the device voltage Vf as shown by a solid line in FIG. 7A (a characteristic referred to as "MI characteristic" hereinafter) or changes to show a curve (not shown) specific to a voltage-controlled-negative-resistance characteristic (a characteristic referred to as "VCNR characteristic" hereinafter, although it is not illustrated). These characteristics of the device current are dependent on a number of factors including the manufacturing method, the conditions where it is gauged and the environment for operating the device. Note that, if the device current If shows a VCNR characteristic relative to the device voltage Vf, the emission current Ie shows an MI characteristic to the device voltage Vf.

Figure 8:
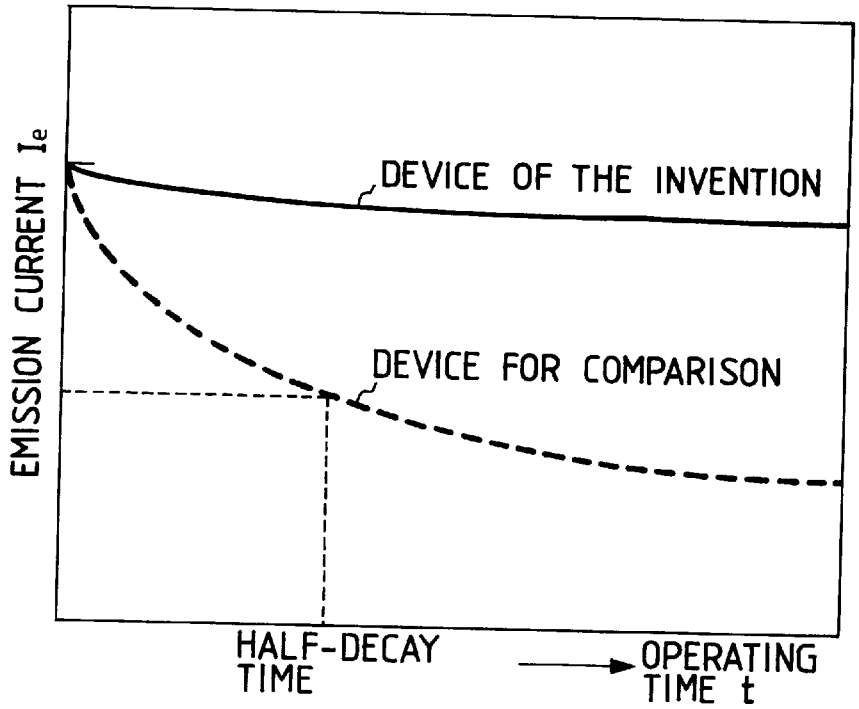
FIG. 8 is a graph showing the change with time of the emission current Ie of an electron-emitting device and that of a comparable known electron-emitting device.

FIG. 8 schematically shows the change with time in the emission current when an electron-emitting device according to the invention is driven to operate by applying a constant pulse voltage to the device. In FIG. 8, the solid line indicates the performance of the device of the invention and the broken line shows that of a comparable device that does not carry any metal oxide coat. It is clear from FIG. 8 that a high level of electron-emitting performance is sustained with an electron-emitting device according to the invention. It may be safe to assume that this sustained performance is the net result of the arrangement of a metal oxide coat 6 that suppresses any degradation of the electroconductive film 4 due to coagulation of the substance of the electroconductive film 4 in and near the electron-emitting region 5.

Because of the remarkable features of an electron-emitting device according to the invention, the electron-emitting behavior of an electron source comprising a plurality of electron-emitting devices according to the invention and hence that of an image-forming apparatus incorporating such an electron source can easily be controlled as a function of input signal and provide clear images because the electron-emitting devices can emit electrons for a prolonged period of time on a stable basis. Thus, such an electron source and an image-forming apparatus may find a variety of applications.

Now, some examples of the usage of electron-emitting devices, to which the present invention is applicable, will be described. According to the invention, an electron source can be realized by arranging a plurality of electron-emitting devices.

Electron-emitting devices may be arranged on a substrate in a number of different modes.

For instance, a number of electron-emitting devices may be arranged in parallel rows along a direction (hereinafter referred to row-direction), each device being connected by wires as at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along an Y-direction to form a matrix, the X- and Y-directions being perpendicular to each other, and the electron-emitting devices on a same row are connected to a common X-directional wire by way of one of the electrodes of each device while the electron-emitting devices on a same column are connected to a common Y-directional wire by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 9:
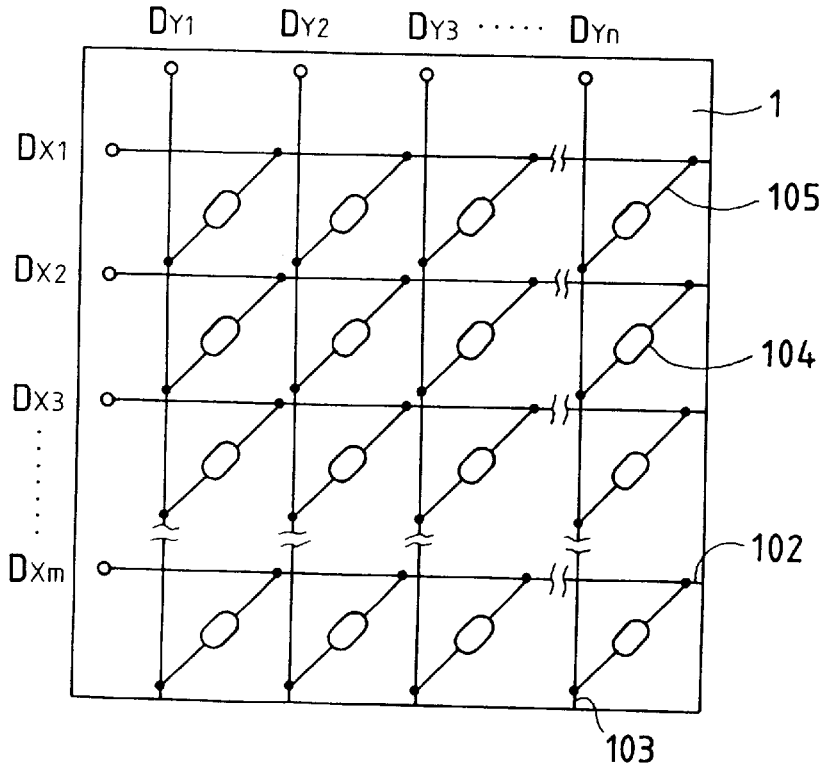
FIG. 9 is a schematic illustration of an electron source according to the invention and having a matrix wiring arrangement.

FIG. 9 is a schematic plan view of the substrate of an electron source realized by arranging a plurality of electron-emitting devices, to which the present invention is applicable, in order to exploit the above characteristic features. In FIG. 9, the electron source comprises an electron source substrate 1, which is a glass substrate as described above and the number and the configuration of the electron-emitting devices 104 arranged on the substrate 1 may be determined depending on the application of the electron source.

There are provided a total of m X-directional wires 102, which are donated by Dx1, Dx2, . . . , Dxm and made of an electroconductive metal produced by vacuum deposition, printing or sputtering. These wires are so designed in terms of material, thickness and width that, if necessary, a substantially equal voltage may be applied to the surface conduction electron-emitting devices. A total of n Y-directional wires 103 are arranged and donated by Dy1, Dy2, . . . , Dyn, which are similar to the X-directional wires 102 in terms of material, thickness and width. An interlayer insulation layer (not shown) is disposed between the m X-directional wires 102 and the n Y-directional wires 103 to electrically isolate them from each other. Both m and n are integers.

The interlayer insulation layer (not shown) is typically made of $SiO_2$ and formed on the entire surface or part of the surface of the insulating substrate 1 to show a desired contour by means of vacuum deposition, printing or sputtering. For example, it may be formed on the entire surface or part of the surface of the substrate 1 on which the X-directional wires 102 have been formed. The thickness, material and manufacturing method of the interlayer insulation layer are so selected as to make it withstand the potential difference between any of the X-directional wires 102 and any of the Y-directional wires 103 observable at the crossing thereof. Each of the X-directional wires 102 and the Y-directional wires 103 is drawn out to form an external terminal.

The oppositely arranged paired electrodes (not shown) of each of the surface conduction electron-emitting devices 104 are connected to related one of the m X-directional wires 102 and related one of the n Y-directional wires 103 by respective connecting wires 105 which are made of an electroconductive metal.

The electroconductive metal material of the device electrodes and that of the connecting wires 105 extending from the wire 102 and 103 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires. Note that the electron-emitting devices 104 may be formed either on the substrate 1 or on an interlayer insulation layer (not shown).

The X-directional wires 102 are electrically connected to a scan signal application means (not shown) for applying a scan signal to a selected row of surface conduction electron-emitting devices 104.

On the other hand, the Y-directional wires 103 are electrically connected to a modulation signal generation means (not shown) for applying a modulation signal to a selected column of surface conduction electron-emitting devices 104 and modulating the selected column according to an input signal. Note that the drive signal to be applied to each surface conduction electron-emitting device is expressed as the voltage difference of the scan signal and the modulation signal applied to the device.

Figure 10:
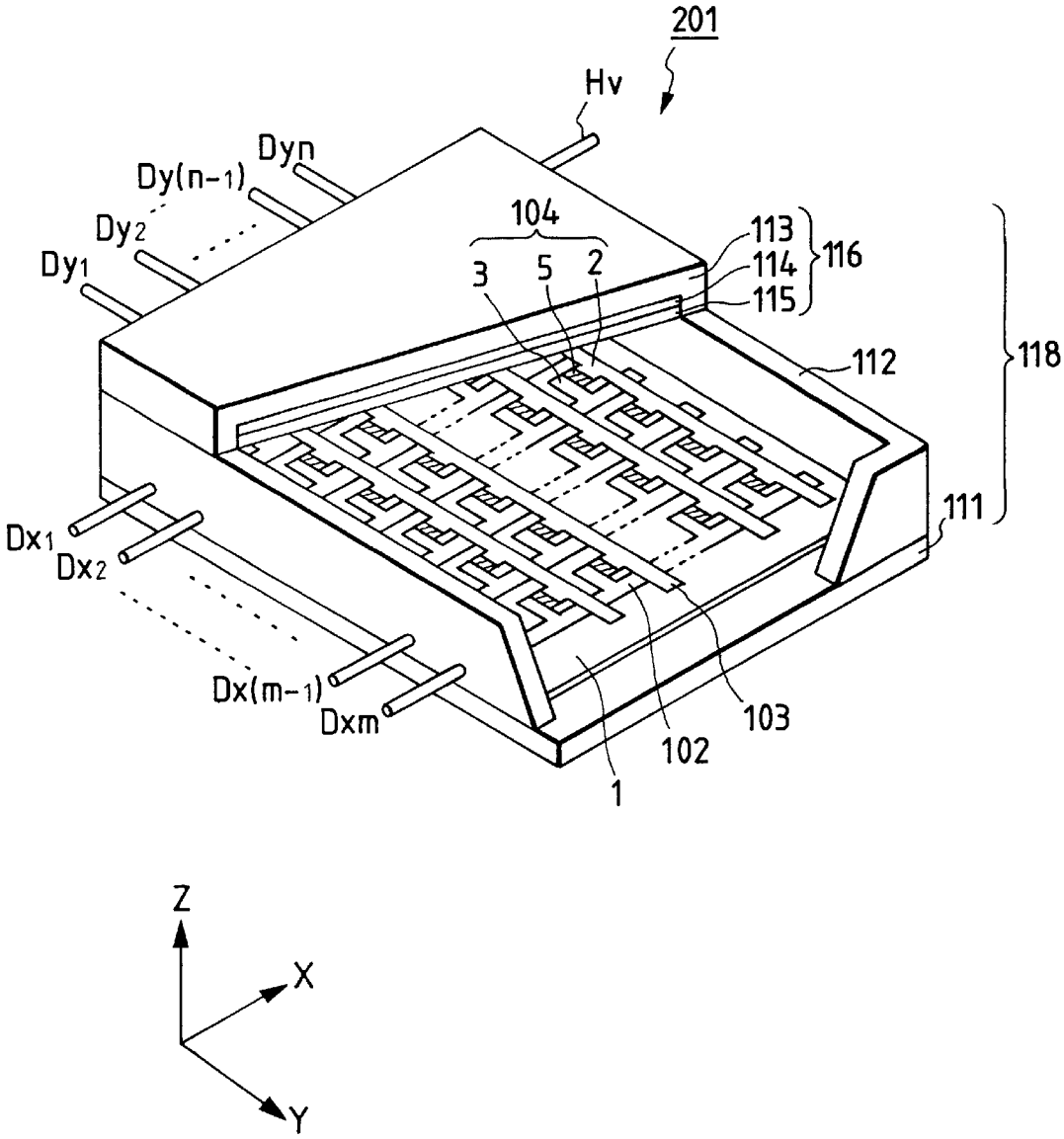
FIG. 10 is a partly cut away schematic perspective view of a display panel that can be used for an image-forming apparatus comprising an electron source with a matrix wiring arrangement according to the invention.
Figure 11A:
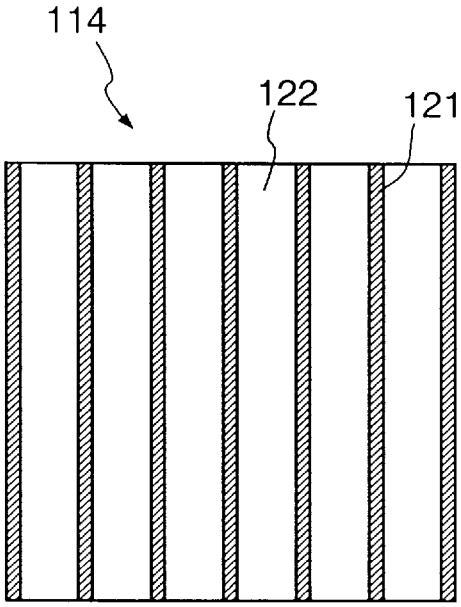
FIGS. 11A and 11B are two possible designs of fluorescent film that can be used for a display panel for the purpose of the invention.
Figure 11B:
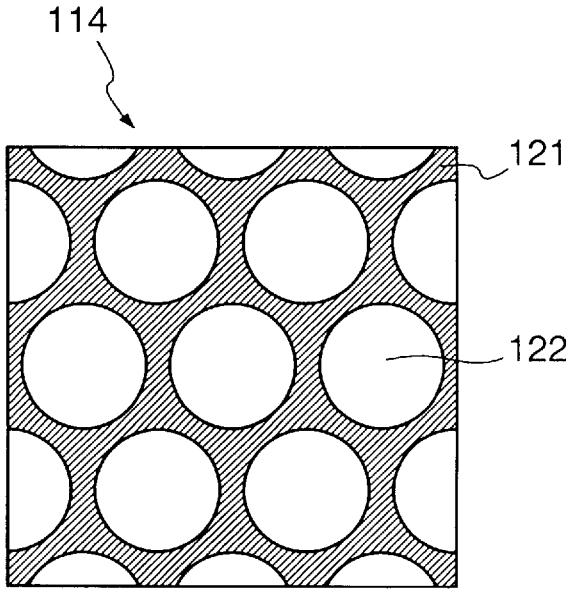
Figure 12:
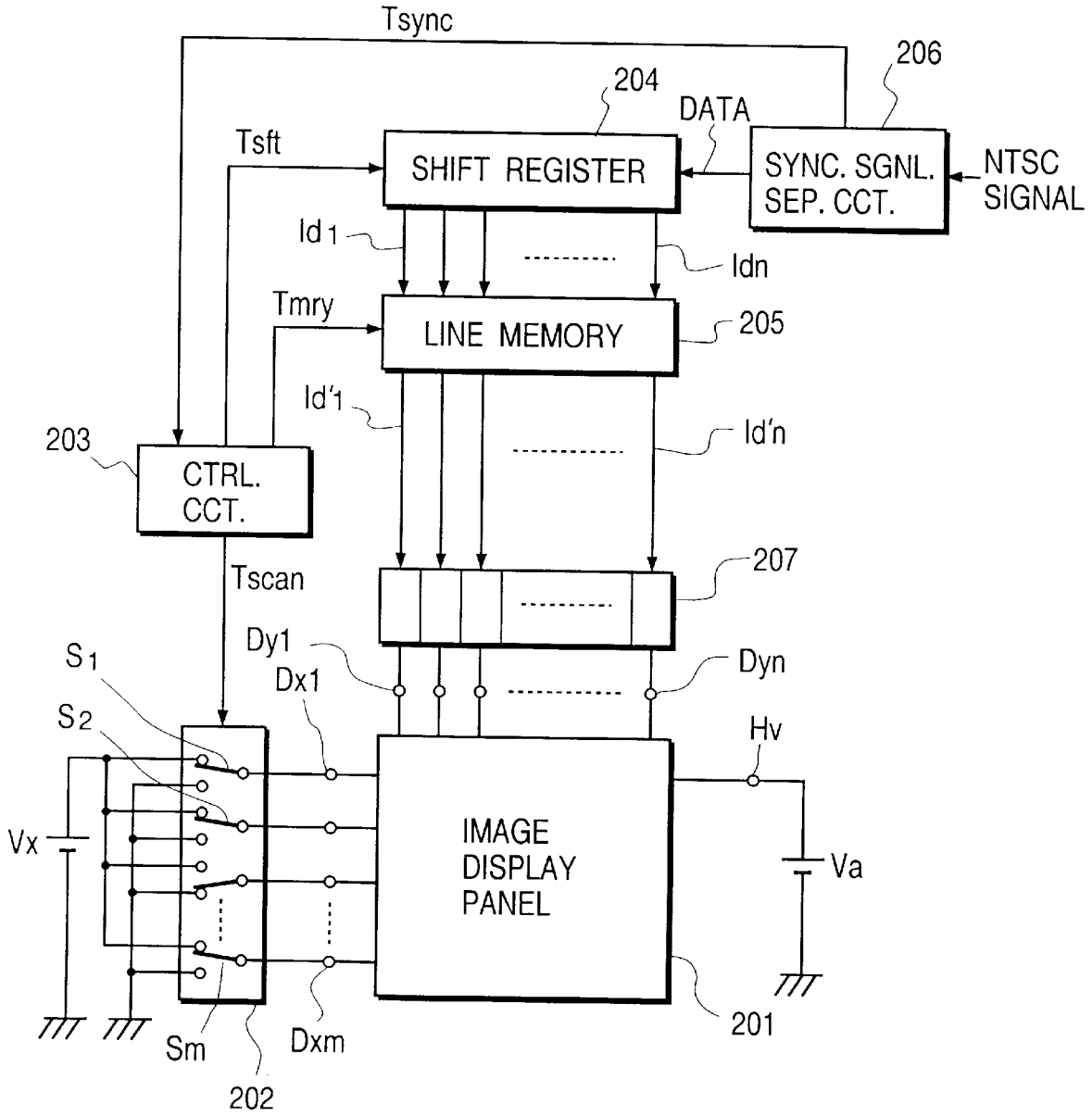
FIG. 12 is a circuit diagram of a drive circuit that can be used to drive a display panel of FIG. 10.

Now, an image-forming apparatus comprising an electron source having a simple matrix arrangement as described above will be described by referring to FIGS. 10 through 12. FIG. 10 is a partially cut away schematic perspective view of the image forming apparatus and FIGS. 11A and 11B show two possible configurations of a fluorescent film that can be used for the image forming apparatus of FIG. 10, whereas FIG. 12 is a block diagram of a drive circuit for the image forming apparatus of FIG. 10 that operates for NTSC television signals.

Referring firstly to FIG. 10 illustrating the basic configuration of the display panel of the image-forming apparatus, it comprises an electron source substrate 1 of the above described type carrying thereon a plurality of electron-emitting devices, a rear plate 111 rigidly holding the electron source substrate 1, a face plate 116 prepared by laying a fluorescent film 114 and a metal back 115 on the inner surface of a glass substrate 113 and a support frame 112, to which the rear plate 111 and the face plate 116 are bonded by means of frit glass. Reference numeral 118 denotes an envelope, which is baked to 400 to 500° C. for more than 10 minutes in the atmosphere or in nitrogen and hermetically and airtightly sealed.

In FIG. 10, reference numerals 102 and 103 respectively denotes X- and Y-directional wires, each being connected to the paired device electrodes 2 and 3 of the related electron-emitting devices 104 and provided with the appropriate one of external terminals Dx1 through Dxm and Dy1 through Dyn.

While the envelope 118 is formed of the face plate 116, the support frame 112 and the rear plate 111 in the above described embodiment, the rear plate 111 may be omitted if the substrate 1 is strong enough by itself because the rear plate 111 is provided mainly for reinforcing the substrate 1. If such as the case, an independent rear plate 111 may not be required and the substrate 1 may be directly bonded to the support frame 112 so that the envelope 118 is constituted of a face plate 116, a support frame 112 and a substrate 1. The overall strength of the envelope 118 may be increased by arranging a number of support members called spacers (not shown) between the face plate 116 and the rear plate 1.

While the fluorescent film 114 may comprise only a single fluorescent body if the display panel is used for showing black and white pictures, it needs to comprise for displaying color pictures black conductive members 121 and fluorescent bodies 122, of which the former are referred to as black stripes (FIG. 11A) or members of a black matrix (FIG. 11B) depending on the arrangement of the fluorescent bodies. Black stripes or members of a black matrix are arranged for a color display panel so that the fluorescent bodies 122 of three different primary colors are made less discriminable and the adverse effect of reducing the contrast of displayed images of external light reflected by the fluorescent film 114 is weakened by blackening the surrounding areas. While graphite is normally used as a principal ingredient of the black stripes, other conductive material having low light transmissivity and reflectivity may alternatively be used.

A precipitation or printing technique is suitably be used for applying a fluorescent material on the glass substrate 113 regardless of black and white or color display. An ordinary metal back 115 is arranged on the inner surface of the fluorescent film 114. The metal back 115 is provided in order to enhance the luminance of the display panel by causing the rays of light emitted from the fluorescent bodies and directed to the inside of the envelope to turn back toward the face plate 116, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum deposition after forming the fluorescent film.

A transparent electrode (not shown) may be formed on the face plate 116 facing the outer surface of the fluorescent film 114 in order to raise the conductivity of the fluorescent film 114.

Care should be taken to accurately align each set of color fluorescent bodies and an electron-emitting device, if a color display is involved, before the above listed components of the envelope are bonded together.

The envelope 118 is evacuated by way of an exhaust pipe (not shown), using an oil free exhaust system typically comprising an ion pump and a sorption pump, while heating the inside appropriately as in the case of the above described stabilizing process to be conducted on each electron-emitting device, until the atmosphere in the inside is reduced to a degree of vacuum of $10^{-5}$ Pa containing organic substances to a very low concentration, when it is hermetically sealed, while being heated appropriately as in the case of the above described stabilization process. A getter process may be conducted in order to maintain the achieved degree of vacuum in the inside of the envelope 118 after it is sealed. In a getter process, a getter arranged at a predetermined position (not shown) in the envelope 118 is heated by means of a resistance heater or a high frequency heater to form a film by vapor deposition immediately before or after the envelope 118 is sealed. A getter typically contains Ba as a principal ingredient and can maintain a degree of vacuum between $10^{-3}$ and $10^{-5}$ by the adsorption effect of the vapor deposition film.

The processes of manufacturing surface conduction electron-emitting devices of the image forming apparatus after the forming process may appropriately be designed to meet the specific requirements of the intended application.

Now, a drive circuits for driving a display panel comprising an electron source with a simple matrix arrangement for displaying television images according to NTSC television signals will be described by referring to FIG. 12. In FIG. 12, reference numeral 201 denotes an image-forming apparatus. Otherwise, the circuit comprises a scan circuit 202, a control circuit 203, a shift register 204, a line memory 205, a synchronizing signal separation circuit 206 and a modulation signal generator 207. Vx and Va in FIG. 12 denote DC voltage sources.

The image-forming apparatus 201 is connected to external circuits via terminals Dx1 through Dxm, Dy1 through Dym and high voltage terminal Hv, of which terminals Dx1 through Dxm are designed to receive scan signals for sequentially driving on a one-by-one basis the rows (of n devices) of an electron source in the apparatus comprising a number of surface-conduction type electron-emitting devices arranged in the form of a matrix having m rows and n columns.

On the other hand, terminals Dy1 through Dyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 202 operates in a manner as follows. The circuit comprises M switching devices (of which only devices S1 and Sm are specifically indicated in FIG. 13), each of which takes either the output voltage of the DC voltage source Vx or OV (the ground potential level) and comes to be connected with one of the terminals Dx1 through Dxm of the display panel 201. Each of the switching devices S1 through Sm operates in accordance with control signal Tscan fed from the control circuit 203 and can be prepared by combining transistors such as FETs.

The control circuit 203 coordinates the operations of related components so that images may be appropriately displayed in accordance with externally fed video signals. It generates control signals Tscan, Tsft and Tmry in response to synchronizing signal Tsync fed from the synchronizing signal separation circuit 206, which will be described below.

The synchronizing signal separation circuit 206 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 206 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 204, is designed as DATA signal.

The shift register 204 carries out for each line a serial/parallel conversion on DATA signals that are serially fed on a time series basis in accordance with control signal Tsft fed from the control circuit 203. (In other words, a control signal Tsft operates as a shift clock for the shift register 204.) A set of data for a line that have undergone a serial/parallel conversion (and correspond to a set of drive data for n electron-emitting devices) are sent out of the shift register 204 as n parallel signals Id1 through Idn.

The line memory 205 is a memory for storing a set of data for a line, which are signals Id1 through Idn, for a required period of time according to control signal Tmry coming from the control circuit 203. The stored data are sent out as I'd1 through I'dn and fed to modulation signal generator 207.

Said modulation signal generator 207 is in fact a signal source that appropriately drives and modulates the operation of each of the surface-conduction type electron-emitting devices and output signals of this device are fed to the surface-conduction type electron-emitting devices in the display panel 201 via terminals Dy1 through Dyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto. Secondly, the level of emission current Ie changes as a function of the change in the applied voltage above the threshold level Vth, although the value of Vth and the relationship between the applied voltage and the emission current may vary depending on the materials, the configuration and the manufacturing method of the electron-emitting device. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either modulation method or pulse width modulation may be used for modulating an electron-emitting device in response to an input signal. With voltage modulation, a voltage modulation type circuit is used for the modulation signal generator 207 so that the peak level of the pulse shaped voltage is modulated according to input data, while the pulse width is held constant.

With pulse width modulation, on the other hand, a pulse width modulation type circuit is used for the modulation signal generator 207 so that the pulse width of the applied voltage may be modulated according to input data, while the peak level of the applied voltage is held constant.

Although it is not particularly mentioned above, the shift register 204 and the line memory 205 may be either of digital or of analog signal type so long as serial/parallel conversions and storage of video signals are conducted at a given rate.

If digital signal type devices are used, output signal DATA of the synchronizing signal separation circuit 206 needs to be digitized. However, such conversion can be easily carried out by arranging an A/D converter at the output of the synchronizing signal separation circuit 206. It may be needless to say that different circuits may be used for the modulation signal generator 207 depending on if output signals of the line memory 205 are digital signals or analog signals. If digital signals are used, a D/A converter circuit of a known type may be used for the modulation signal generator 207 and an amplifier circuit may additionally be used, if necessary. As for pulse width modulation, the modulation signal generator 207 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 207 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus comprising a display panel 201 and a drive circuit having a configuration as described above, to which the present invention is applicable, the electron-emitting devices emit electrons as a voltage is applied thereto by way of the external terminals Dx1 through Dxm and Dy1 through Dyn. Then, the generated electron beams are accelerated by applying a high voltage to the metal back 115 or a transparent electrode (not shown) by way of the high voltage terminal Hv. The accelerated electrons eventually collide with the fluorescent film 114, which by turn emits light to produce images according NTSC television signals.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 13 and 14.

Figure 13:
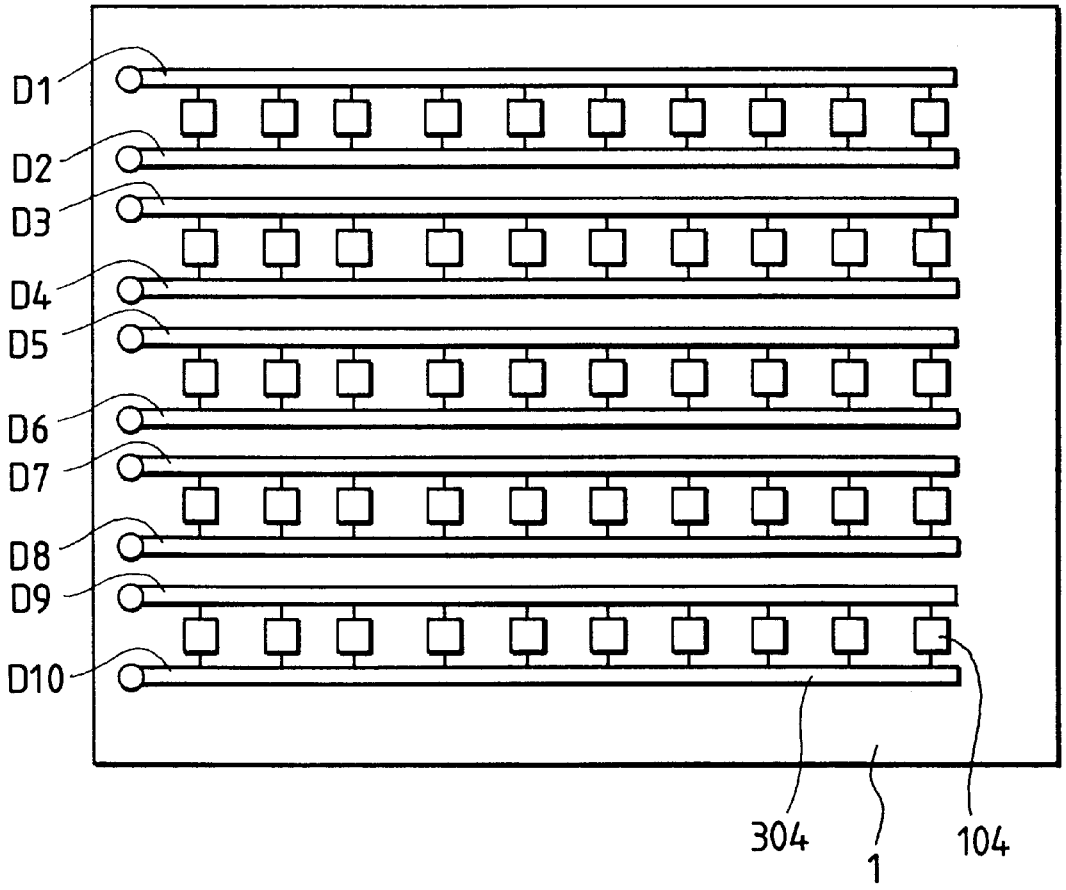
FIG. 13 is a schematic plan view of an electron source according to the invention and having a ladder-type wiring arrangement.

Firstly referring to FIG. 13 schematically showing an electron source having a ladder-like arrangement, reference numeral 1 denotes an electron source substrate and reference numeral 104 denotes a surface conduction electron-emitting device arranged on the substrate, whereas reference numeral 304 denotes common wires for connecting the surface conduction electron-emitting devices and by turn provided with respective external terminals D1 through D10. The electron-emitting devices 104 are arranged in rows (to be referred to as device rows hereinafter) on the substrate 1 to form an electron source comprising a plurality of device rows, each row having a plurality of devices.

The surface conduction electron-emitting devices of each device row are electrically connected in parallel with each other by a pair of common wires 304 (for examples common wires 304 connected to the external terminals D1 and D2) so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, for example, of the external terminals connected to the respective common wires 304, external terminal pairs D2 and D3, D4 and D5, D6 and D7 and D8 and D9 can share a single common wire instead of two.

Figure 14:
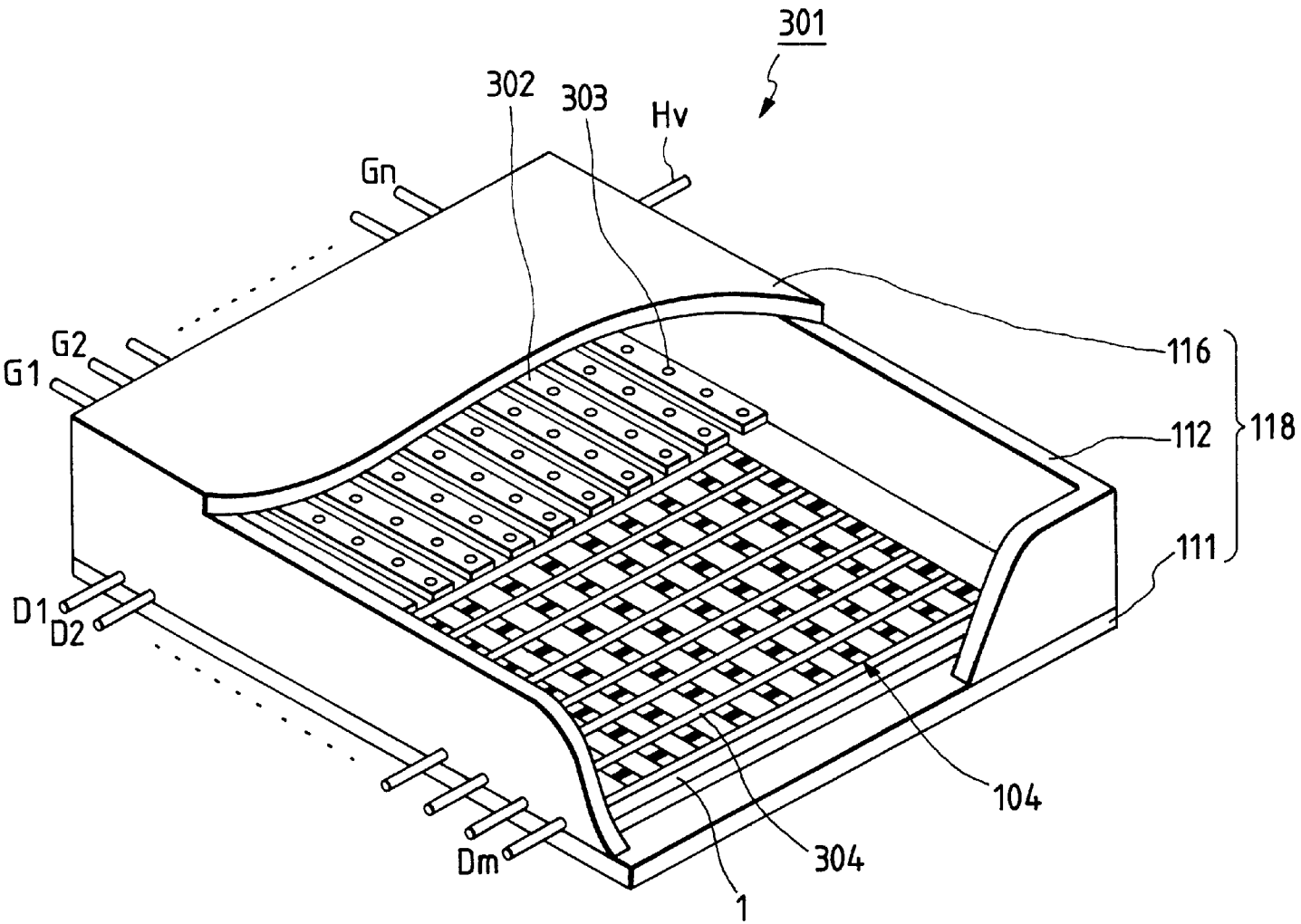
FIG. 14 is a partly cut away schematic perspective view of a display panel that can be used for an image-forming apparatus comprising an electron source with a ladder-type wiring arrangement according to the invention.

FIG. 14 is a schematic perspective view of the display panel of an image-forming apparatus incorporating an electron source having a ladder-like arrangement of electron-emitting devices. In FIG. 14, the display panel comprises grid electrodes 302, each provided with a number of bores 303 for allowing electrons to pass therethrough and a set of external terminals Dx1 through Dxm, along with another set of external terminals G1, G2, . . . , Gn, connected to the respective grid electrodes 302. The common wires 304 for connecting respective device rows are formed integrally with the electron-emitting devices on the substrate 1.

Note that the components of the display panel of FIG. 14 that are same or similar to those of FIGS. 10 and 13 are denoted respectively by the same reference symbols. The display panel of FIG. 14 differs from the display panel comprising an electron source with a simple matrix arrangement of FIG. 10 mainly in that the apparatus of FIG. 14 has grid electrodes 302 arranged between the substrate 1 and the face plate 116.

In FIG. 14, the stripe-shaped grid electrodes 302 are arranged between the substrate 1 and the face plate 116 perpendicularly relative to the ladder-like device rows for modulating electron beams emitted from the surface conduction electron-emitting devices 104, each provided with through bores 303 in correspondence to respective electron-emitting devices for allowing electron beams to pass therethrough. Note that, however, while stripe-shaped grid electrodes are shown in FIG. 14, the profile and the locations of the electrodes are not limited thereto. For example, the grid electrodes 302 may alternatively be provided with mesh-like openings 303 and arranged around or close to the surface conduction electron-emitting devices 104.

The external terminals D1 through Dm and the external terminals G1 through Gn for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of examples. However, it should be noted that the present invention is not limited thereto and they are subject to changes and modifications in terms of individual components and the entire design without departing from the scope of the invention.

EXAMPLE 1

FIGS. 1A and 1B schematically illustrate an electron-emitting device prepared in this example. The process employed for manufacturing the electron-emitting device will be described by referring to FIGS. 4A through 4D.

Step-A

In each example, after thoroughly cleansing a soda lime glass plate, a silicon oxide film was formed thereon to a thickness of 0.5 $\mu$m by sputtering to produce a substrate 1, on which a pattern of photoresist (RD-2000N-41: available from Hitachi Chemical Co., Ltd.) having openings corresponding to the pattern of a pair of device electrodes 2 and 3 was formed. Then, a Ti film and an Ni film were sequentially formed to respective thicknesses of 5 nm and 100 nm by vacuum deposition. Thereafter, the photoresist was dissolved by an organic solvent and the Ni/Ti film was lifted off to produce a pair of device electrodes 2 and 3. The device electrodes was separated by a distance L of 10 $\mu$m and had a width W of 300 $\mu$m.

Step-B

To produce an electroconductive thin film 4, a mask of Cr film was formed on the device to a thickness of 100 nm by vacuum deposition and then an opening corresponding the pattern of an electroconductive thin film was formed by photolithography. Thereafter, an organic Pd solution (ccp4230: available from Okuno Pharmaceutical Co., Ltd.) was applied to the Cr film by means of a spinner and calcined at 300° C. for 10 minutes in the atmosphere. Then, the Cr mask was removed by wet-etching to obtain an electroconductive thin film 3 having a desired profile by lift-off (FIG. 4B). The electroconductive film 4 was a film of fine particles containing PdO as principal ingredient having a film thickness of 10 nm and an electric resistance of $Rs=2\times10^4$ Ω/□.

Step-C

After cleaning and drying the above described device for another time, it was placed in the vacuum chamber 55 of a gauging system as illustrated in FIG. 6 and the vacuum chamber 55 of the system was evacuated by means of a vacuum pump unit 56 to a pressure of $1.3\times10^{-6}$ Pa and, thereafter, a metal oxide coat 6 was formed by electron beam evaporation, using magnesium oxide as vapor source (FIG. 4C). The coat was made to show a thickness of 2 nm. (Note that no equipment for vacuum evaporation is shown in FIG. 6.)

In an experiment, magnesium oxide was deposited on a silicon substrate and the deposit was examined by X-ray photo-electron spectroscopy to find that a thin film of magnesium oxide had been formed and the film contained carbonate by about 20%.

Step-D

Keeping the device in the vacuum chamber 55, a pulse voltage was applied between the device electrodes 2 and 3 from the power source 51 to carry out an electric forming process and produce an electron emitting region 5 in the electroconductive thin film 4 (FIG. 4D).

The applied voltage was not a triangular pulse voltage but a rectangular pulse voltage whose peak value gradually increased with time as shown in FIG. 5B. The pulse width of T1=1 msec and the pulse interval of T2=10 msec were used. During the electric forming process, an extra pulse voltage of 0.1 V (not shown) was inserted into intervals of the forming pulse voltage in order to determine the resistance of the electron-emitting device and the electric forming process was terminated when the resistance exceeded 1 MΩ.

The forming power consumption rate (the power consumption rate to obtain the largest device current during the energization forming process) was about 70 mW. When compared with another device prepared in the above described manner except that no metal oxide coat 6 had been formed, the forming power consumption rate was about 1.3 times greater for the device of this example.

Thereafter, device was heated to 150° C. for 5 hours to reduce the PdO of the electroconductive film to Pd. The magnesium oxide MgO was not reduced by this heating.

Step-E

Subsequently, n-hexane was introduced into the vacuum chamber by way of an inlet valve (not shown) to produce a pressure of $1.3\times10^{-3}$ Pa in the inside of the vacuum chamber. Then, an activation process was carried out by applying a rectangular pulse voltage with a wave height of 14V, a pulse width of T1=1 msec. and a pulse interval of T2=10 msec.

During the activation process, the emission current Ie of the device was observed and the application of the pulse voltage and the introduction of n-hexane were stopped to terminate the activation process when the electron-emission efficiency η(=Ie/If) got to a peak 30 minutes after the start of the activation process.

The electron-emitting performance of the prepared electron-emitting device was observed also by means of the above gauging system. For this experiment, the anode and the electron-emitting device were separated by 5 mm and a potential difference between them was held to 1 kV. The pressure in the inside of the vacuum chamber was held to $1.3\times10^{-4}$ Pa and a pulse voltage having a wave height of 14V was applied to the device for observation.

When compared for the change with time of the emission current Ie of the device of this example with the above described other device prepared in the above described manner except that no metal oxide coat 6 had been formed, the emission current Ie of the device of this example showed little change with time as schematically shown in FIG. 8. Note that the lines in FIG. 8 are expressed in relative terms and the emission currents of the two devices were not equal at the beginning of the experiment.

After the experiment, the electron-emitting regions of the two electron-emitting devices were observed by means of a high resolution scanning electronic microscope (SEM) to find that fine particles of the electroconductive film had been coagulated in a number of spots in and near the electron-emitting region of the device for comparison, whereas the electroconductive film of the device of this example did not particularly show any such coagulation.

Apart from the above devices, devices were prepared with metal oxide coats having respective thicknesses of 0.5, 1, 3.5, 5, 10, 20 and 30 nm and subjected to a similar experiment.

Of them, an energization forming process could hardly be conducted on the devices with a metal oxide coat that was 20 nm thick or more. Although a number of devices were repeatedly prepared with such metal oxide coat thicknesses, many of them did not produce any electron-emitting region. The device with a 5 nm thick metal oxide coat showed a forming power consumption rate of about 0.1W and an emission current lower than that of the device of this example. However, it operated stably for electron emission just like the device of this example when a pulse wave height of 25V was used for Step-e above and the observation of the performance. The device with a 1 nm thick metal oxide coat showed a level of Ie similar to that of the device of this example but Ie changed more remarkably with time. The device with a 0.5 nm thick metal oxide coat did not show any significant improvement in the change with time of Ie if compared with the device prepared for comparison. The device a 30 nm thick metal oxide coat did not emit electrons until the pulse voltage wave height was raised to 40V.

The fall with time of Ie observed on the devices having the film thickness of 3.5 nm or more was even smaller than the device with a film thickness of 2 nm. On the other hand, the value of η=Ie/If gradually rose as the film thickness increased from 3.5 nm to 10 nm. The inventors of the present invention assume that this is because the effect of elastic scattering increased with the film thickness as MgO has a low work function.

The emission current was frequently unstable with the device having a film thickness of 20 nm. This may be because the metal oxide coat was thick and electrons colliding with the coat could not flow into the electroconductive film satisfactorily to give rise to an overcharged state, which by turn adversely affected the emitted electrons and made them show unstable trajectories.

From the above observations, the metal oxide coat mainly made of MgO preferably has a film thickness between 3.5 and 10 nm.

Additionally, devices were prepared by using in combination Pd, Ni, Pt and Au films formed by sputtering for the electroconductive film 4 and $Al_2O_3$, $Y_2O_3$ and $ZrO_2$ formed either by electron beam evaporation or CVD for the metal oxide coat 6 and their performances were observed to obtain similar results.

EXAMPLE 2

After carrying out Steps-a and b for the device of this example as in Example 1, the device was subjected to an energization forming process and a reducing process as described above by referring to Step-d in Example 1. Subsequently, a metal oxide coat 6 was formed on the device by following Step-c of Example 1 and then the device was subjected to an activation process of Step-e in Example 1.

Figure 21A:
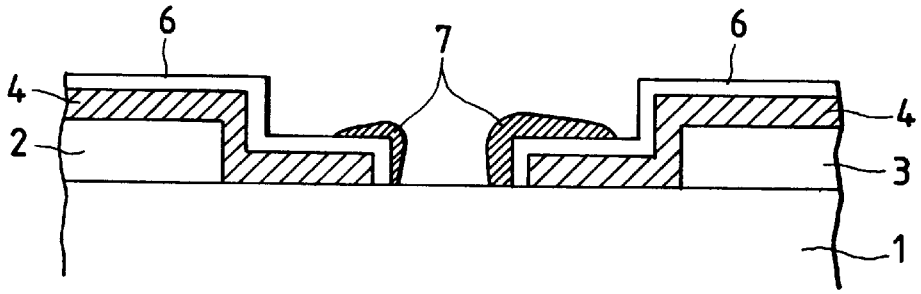
FIGS. 21A through 21C are schematic partial sectional views of the electron-emitting region and its vicinity of an electron-emitting device according to the invention, illustrating different possible locational relationships of the electroconductive film, the metal oxide coat and the deposited carbon.

FIG. 21A schematically shows the configuration of the device of this example. As shown, it comprised a substrate 1, a pair of device electrodes 2 and 3 and an electroconductive film 4 which was covered by a metal oxide coat 6 made mainly of MgO. Carbon 7 was deposited on and around the electron-emitting region as a result of an activation process. Note that, in FIG. 21A, the carbon 7 do not completely cover the metal oxide coat 6 and the surface of the metal oxide coat 6 is randomly exposed at a number of different areas.

When tested as the device of Example 1, the emission current Ie of the device of this example showed little change with time. After the experiment, the electron-emitting region of the electron-emitting device was observed through a SEM to obtain a result similar to that of Example 1.

As in the case of Example 1, apart from the above devices, devices were prepared with metal oxide coats having respective thicknesses of 0.5, 1, 3.5, 5, 10, 20 and 30 nm and subjected to a similar experiment. The device with a 30 nm thick metal oxide coat showed only a low level of Ie. The device with a 20 nm thick metal oxide coat showed a level of Ie that was about a half of that of Ie of the device of this example. The devices with 1, 3.5, 5 and 10 nm thick metal oxide coats operated substantially same as the device of this example. The device with a 0.5 nm thick metal oxide did not show any significant effect of suppressing the change with time of Ie.

Additionally, devices were prepared by using in combination Pd, Ni, Pt and Au films formed by sputtering for the electroconductive film 4 and $Al_2O_3$, $Y_2O_3$ and $ZrO_2$ formed either by electron beam evaporation or CVD for the metal oxide coat 6 and their performances were observed to obtain similar results.

EXAMPLE 3

Figure 5C:
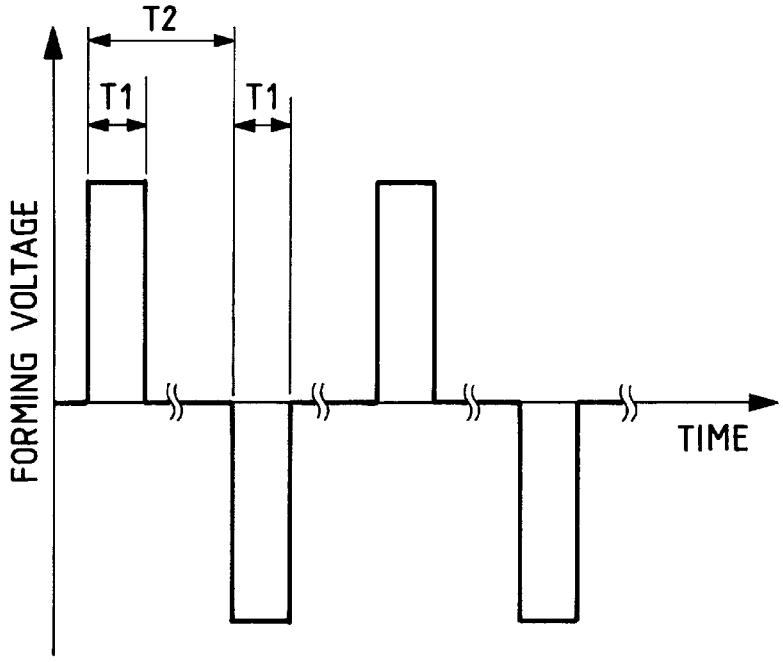

After following Steps-a, b, d and c as in Example 2, an activation process was carried out by applying a rectangular pulse voltage with alternated polarities as shown in FIG. 5C. The pulse width was T1=1 msec. for the both polarities and the pulse interval between the positive polarity and the negative polarity was T2'=10 msec.

Figure 21B:
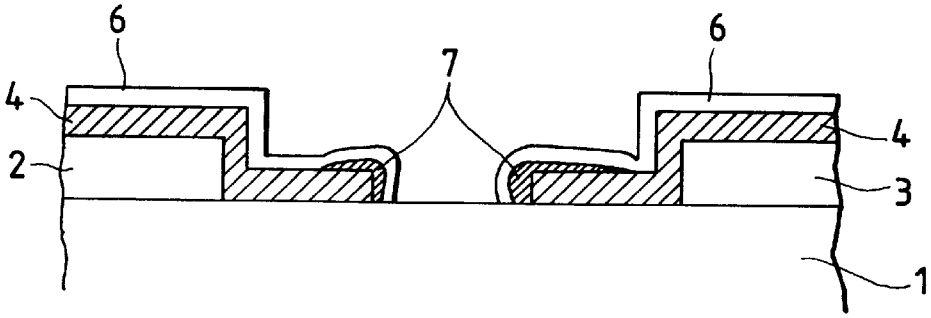
Figure 21C:
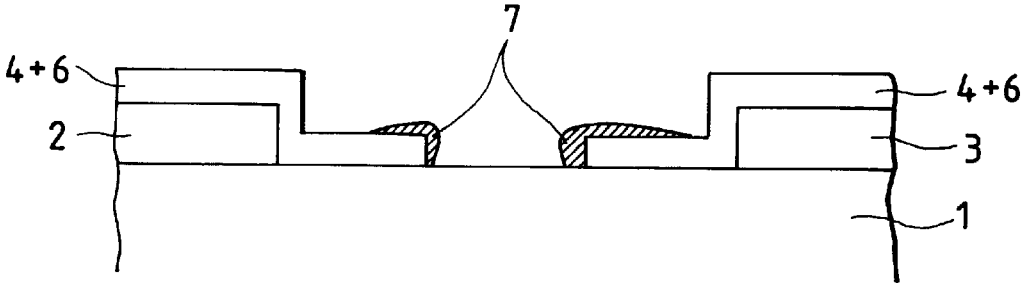

While a relatively large amount of carbon 7 was deposited on the high potential side of the device of Example 2 by activation, a substantially same amount of carbon was deposited on the both sides of this example as schematically shown in FIG. 21B.

The performance of the device of this example was similar to that of the device of Example 2.

EXAMPLE 4

The procedures of Example 1 were followed down to Step-b in this example and thereafter the energization forming process of Step-d and the activation process of Step-e were conducted. Subsequently, a metal oxide coat 6 was formed in Step-c in the following manner.

Step-C

After evacuating the vacuum chamber of the gauging system to $1.3\times10^{-6}$ Pa, the internal pressure was raised to $1.3\times10^{-3}$ Pa by introducing oxygen. A metal oxide coat 6 was formed by electron beam evaporation, using $Y_2O_3$ as vapor source. The coat was made to show a thickness of 2 nm. In an experiment, a $Y_2O_3$ film was formed on a silicon substrate under the same conditions and examined by X-ray photo-electron spectroscopy to find that a $Y_2O_3$ thin film having a stoichiometric composition had been formed. The electron-emitting device of this example has a configuration as shown in FIG. 21B. In the device of this example, a metal oxide coat 6 mainly made of $Y_2O_3$ was formed on the electroconductive film 4 and the carbon 7 deposited by the activation process.

The obtained electron-emitting device was evaluated as in Examples 1 and 2.

Since the device of this example produced a sufficiently large emission current Ie for a relatively low device voltage Vf, a rectangular pulse voltage with a wave height of 10V was applied for the evaluation. The emission current Ie changed little with time.

The reasons why the device of this example could be driven by a pulse voltage with a relatively low wave height may include that the electron-emitting region could emit electrons at an enhanced rate because of the existence of a metal oxide coat 6 having a low work function on the top of the device and that electrons could be elastically scattered on the electroconductive film with an improved probability.

Subsequently, as in the case of Example 2 and apart from the above devices, devices were prepared with metal oxide coats having respective thicknesses of 0.5, 1, 3.5, 5, 10, 20 and 30 nm and subjected to a similar experiment.

The device with a 30 nm thick metal oxide coat showed only a low level of emission current. The device with a 20 nm thick metal oxide coat often showed an unstable Ie. The change with time of Ie of the devices with 3.5 nm to 10 nm thick metal oxide coats was even smaller than that of the device with a 2 nm thick coat and the value of $\eta$=Ie /If gradually rose with the coat thickness as in the case of Example 1. The change with time of Ie of the device with a 1 nm coat thickness was relatively large. The device with a 0.5 nm thick metal oxide coat did not show any significant effect of suppressing the change with time of Ie.

Additionally, devices were prepared by using in combination Pd, Ni, Pt and Au films formed by sputtering for the electroconductive film 4 and $Al_2O_3$, $Y_2O_3$ and $ZrO_2$ formed either by electron beam evaporation or CVD for the metal oxide coat 6 and their performances were observed to obtain similar results. A large Ie was obtained for the devices with a coat having thickness of between 3.5 and 10 nm and containing MgO and $ZrO_2$ that have a low work function.

EXAMPLE 5

The procedures of Example 1 were followed down to Step-b in this example and thereafter a metal oxide coat 6 was formed in Step-c in the following manner.

Step-C

An isopropanol solution contain magnesium isopropoxide by 3 wt % was applied to the device by means of a spinner and then heated and calcined at 410° C. in the atmosphere for 20 minutes. In an experiment, a silicon substrate was subjected to the process of Step-c under the same conditions and examined by X-ray photo-electron spectroscopy to find that an MgO thin film having a thickness of 10 nm had been formed. The film contained magnesium carbonate $MgCO_3$ to a small concentration.

Then, Steps-d and e were followed. The power consumption rate for the energization forming process was 60 mW. Acetone was introduced into the vacuum chamber for the subsequent activation process to produce a pressure of $1.3\times10^{-2}$ Pa.

The results of observation obtained for the device of this example and the devices obtained by modifying the MgO film thickness and using different materials for the electroconductive film were similar to those of Example 1.

EXAMPLE 6

In this example, subsequent to Step-a of Example 1, a mixture of a solution of an organic Pd compound as described above and an isopropranol solution of magnesium isopropoxide used in Example 5 was applied to the device by means of a spinner and then baked in the atmosphere. The mixing ratio was so regulated that the mole ratio of Mg relative to the entire metal elements (Pd and Mg) was held to 20%. Subsequently, an energization forming process and an activation process was carried out as in the case of Steps-d and e of Example 1. The power consumption rate of the energization forming process was about 70 mW. The results of observation obtained for the device of this example were similar to those of Example 1.

In an experiments, devices were prepared with different Mg mole ratios. No effect of suppressing the change with time of the emission current was observed when the mole ratio of Mg was lower than 10%. As the Mg mole ratio rose, the power consumption rate of the energization forming process also rose and, in some cases, no forming operation could be conducted when the Mg mole ratio exceeded 50%.

In an electron-emitting device prepared by following the procedures of this example, the voids of the fine particles of the electroconductive film are filled with a metal oxide material typically as shown in FIG. 2A or FIG. 2C depending on the ratio of Mg to Pd contained in the metal oxide material and the electroconductive film. The electron-emitting region and its vicinity show a view as shown in FIG. 21C, where reference symbol "4+6" indicates an electroconductive film containing a metal oxide material therein.

EXAMPLE 7

In this example, a device was prepared as in Example 5 except that bariumisopropoxide was used for the metal oxide coat 6 to realize a metal oxide coat mainly made of BaO. The performance of the device of this example was similar to that of the device of Example 4.

EXAMPLE 8

In this example, a device was prepared as in Example 1 except that aluminumisopropoxide was used for the metal oxide coat 6 to realize a metal oxide coat mainly made of $Al_2O_3$. The performance of the device of this example was similar to that of the device of Example 5.

EXAMPLE 9

In this example, a device was prepared as in Example 5 except that titaniumisopropoxide was used for the metal oxide coat 6 to realize a metal oxide coat mainly made of TiO. The performance of the device of this example was similar to that of the device of Example 5.

EXAMPLE 10

In this example, a device was prepared as in Example 5 except that zirconiumisopropoxide was used for the metal oxide coat 6 to realize a metal oxide coat mainly made of $ZrO_2$. The performance of the device of this example was similar to that of the device of Example 5.

EXAMPLE 11

In this example, the Steps-a and b of Example 1 were followed and a energization forming process was carried out as in Step-d of Example 1. Subsequently, a metal oxide coat 6 mainly made of $Al_2O_3$ was formed as in Example 6 and then an activation process was carried out as in Step-e of Example 5.

The performance of the device of this example was similar to that of the device of Example 5.

EXAMPLE 12

In this example, the Steps-a and b of Example 1 were followed.

Step-C

After forming a pair of device electrodes 2 and 3 and an electroconductive film 4 on a substrate 1, the surface of the substrate 1 was treated by $UV/O_3$ to make it hydrophilic and then it was turned to hydrophobic by forming a single layer of monomolecular film of octadecileamine by an ordinary LB technique. Thereafter, 30 layers of magnesium arachidiate were sequentially formed for accumulation.

More specifically, magnesium chloride 6 hydrate was dissolved into the underlying water on which a monomolecular film was developed until an $Mg^{2+}$ion concentration of 0.5 mM/liter was obtained and then the pH value of the underlying water was regulated and held to 9.0 by means of tri(hydroxymethyl)aminomethaneacetate. A 2.0 mM/liter chloroform arachidiate was added dropwise on the surface of the underlying water to develop a monomolecular film of magnesium arachidiate on the interface, which was then taken up repeatedly on the substrate 1 by an ordinary LB technique (vertical immersion technique), maintaining the surface pressure to 25 mN/m.

Then, the accumulated films were heat treated at 410° C. in the atmosphere for 20 minutes to produce a metal oxide coat 6 by pyrolysis. In an experiment, a silicon substrate was subjected to the process of Step-c under the same conditions to produce a metal oxide coat on the substrate and examined by ellipsometry and X-ray photo-electron spectroscopy to find that an MgO thin film having a thickness of 4.5 nm had been formed.

Then, the device was subjected to an energization forming process and a reducing process as described above by referring to Step-d in Example 1. Subsequently, the device was subjected to an activation process of Step-e in Example 1.

The performance of the device of this example was similar to that of the device of Example 1. The electron-emitting region of the electron-emitting device was observed through a SEM to obtain a result similar to that of Example 1.

EXAMPLE 13

In this example, a device was prepared as in Example 5 except that a metal oxide coat 6 of calcium oxide was formed by modifying the procedures from Step-c as follows.

Calcium chloride 2 hydrate was dissolved into the underlying water until a $Ca^{2+}$ ion concentration of 0.1 mM/liter was obtained and then the pH value of the underlying water was regulated and held to 9.5 by means of TRIS-acetate. A 3.0 mM/liter chloroform stearate was added dropwise on the surface of the underlying water and thereafter, the corresponding procedures of Example 12 were followed to produce a metal oxide coat 6.

The performance of the device of this example was similar to that of the device of Example 1.

EXAMPLE 14

In this example, a device was prepared as in Example 12 except that a metal oxide coat 6 of yttrium oxide $Y_2O_3$ was formed by modifying the procedures from Step-c as follows.

Yttrium chloride was dissolved into the underlying water until a $Y^{3+}$ ion concentration of 0.01 mM/liter was obtained and then the pH value of the underlying water was regulated and held to 8.0 by means of aqueous ammonia. A 3.0 mM/liter chloroform arachidiate was added dropwise on the surface of the underlying water and thereafter, the corresponding procedures of Example 12 were followed to produce a metal oxide coat 6. Note, however, that the heat treatment temperature was 500° C.

The performance of the device of this example was similar to that of the device of Example 1.

EXAMPLE 15

In this example, a device was prepared as in Example 12 except that a metal oxide coat 6 of aluminum oxide $Al_2O_3$ was formed by modifying the procedures from Step-c as follows.

Potassium aluminum sulfate 12 hydrate was dissolved into the underlying water until an aluminum ion concentration of 0.01 mM/liter was obtained and then the pH value of the underlying water was regulated and held to 4.8 by means of hydrogen chloride. A 3.0 mM/liter chloroform stearate was added dropwise on the surface of the underlying water and thereafter, the corresponding procedures of Example 12 were followed to produce a metal oxide coat 6. Note, however, that a moving wall type through was used for forming an LB film.

The performance of the device of this example was similar to that of the device of Example 1.

EXAMPLE 16

In this example, a device was prepared as in Example 12 except that a metal oxide coat 6 of lanthanum oxide $La_2O_3$ was formed by modifying the procedures from Step-c as follows.

Lanthanum chloride 7 hydrate was dissolved into the underlying water until a $La^{3+}$ ion concentration of 0.1 mM/liter was obtained and then the pH value of the underlying water was regulated and held to 6.6 by means of glycine-hydrogen chloride. A 3.0 mM/liter chloroform stearate was added dropwise on the surface of the underlying water and thereafter, the corresponding procedures of Example 12 were followed to produce a metal oxide coat 6.

The performance of the device of this example was similar to that of the device of Example 1.

EXAMPLE 17

In this example, a device was prepared as in Example 12 except that a metal oxide coat 6 of titanium oxide $TiO_2$ was formed by modifying the procedures from Step-c as follows.

Titanium potassium oxalate 2 hydrate was dissolved into the underlying water until an titanium oxalate ion concentration of 0.1 mM/liter was obtained and then the pH value of the underlying water was regulated and held to 4.0 by means of hydrogen chloride. A 3.0 mM/liter octadecileaminechloroform solution was added dropwise on the surface of the underlying water to accumulate octadecileammonium-titanium oxalate complex as in Example 10, which was then heat treated to produce a metal oxide coat 6. Note, however, that the heat treatment temperature was 600° C.

The performance of the device of this example was similar to that of the device of Example 1.

EXAMPLE 18

In this examples, a device was prepared by carrying out Steps-a, b and d of Example 1 and then a metal oxide coat 6 was formed according to Step-c of Example 10, which was followed by Step-e for an activation process.

The performance of the device of this example was similar to that of the device of Example 1.

EXAMPLE 19

In this example, an image-forming apparatus shown in FIG. 10 and comprising electron source realized by arranging a large number of surface conduction electron-emitting devices arranged on a substrate and provided with a matrix wiring arrangement was prepared.

Figure 15:
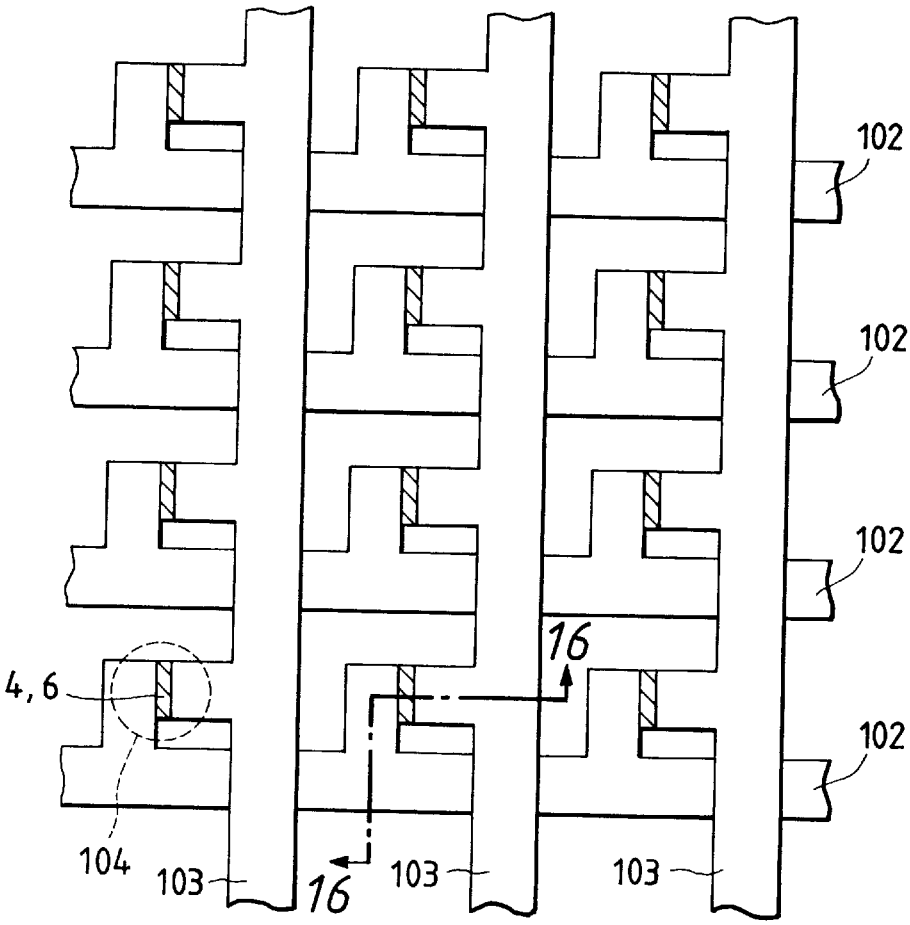
FIG. 15 is a schematic partial plan view of an electron source with a matrix wiring arrangement according to the invention.
Figure 16:
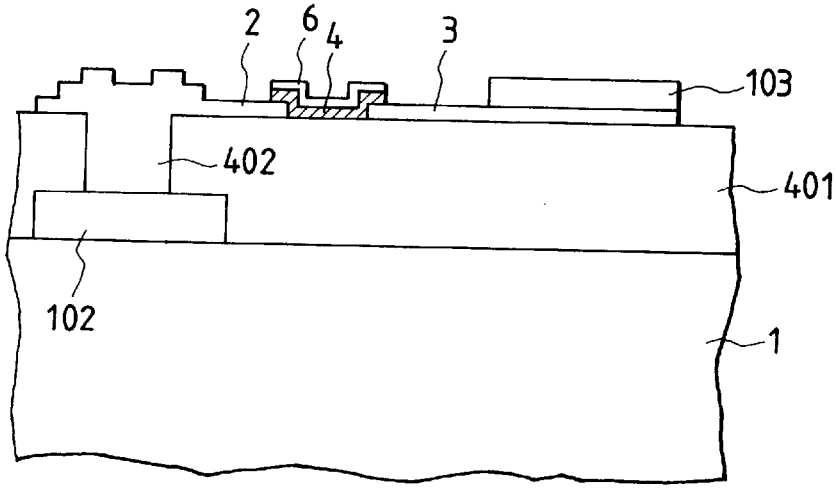
FIG. 16 is a schematic cross sectional view of the electron source of FIG. 15 taken along line 16—16.
Figure 17A:
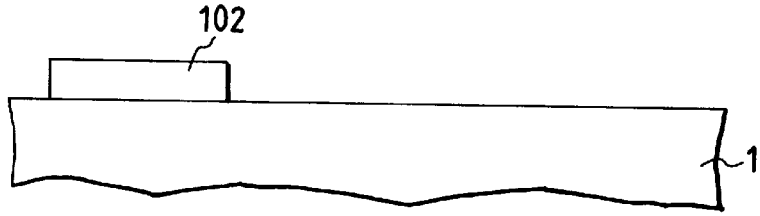
FIGS. 17A through 17I are schematic partial sectional views of the electron source of FIG. 15, illustrating different manufacturing steps.
Figure 17B:
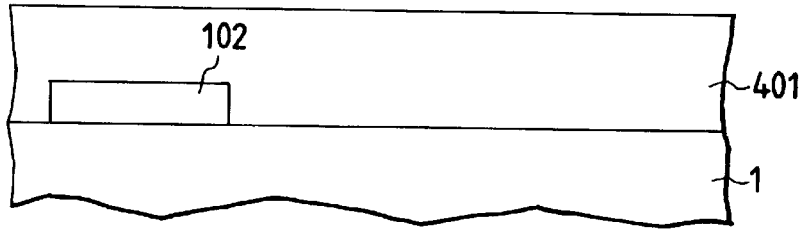
Figure 17C:
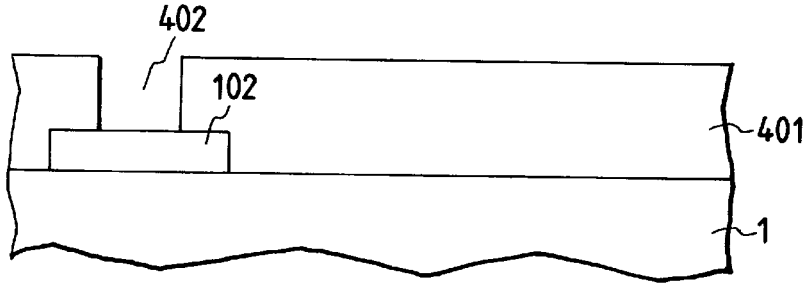
Figure 17D:
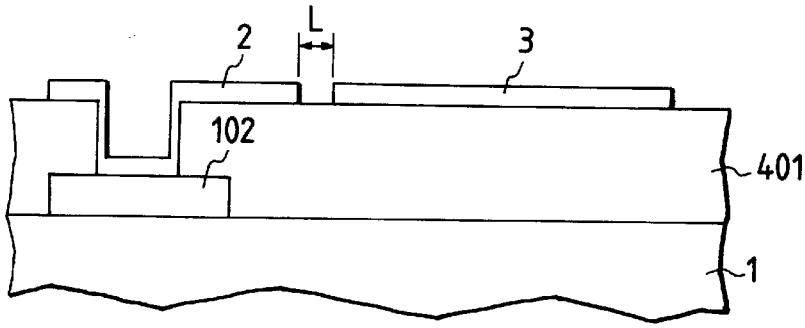
Figure 17E:
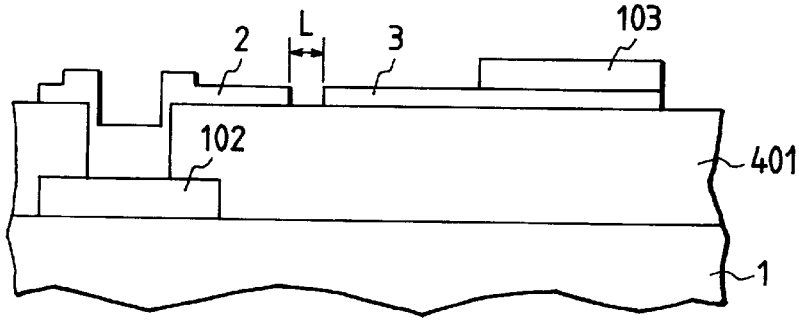
Figure 17F:
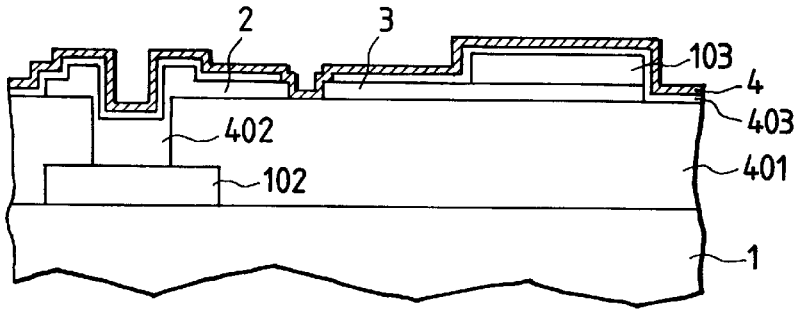
Figure 17G:
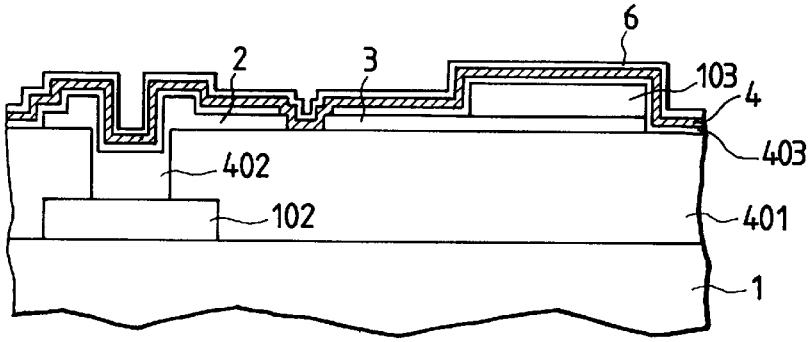
Figure 17H:
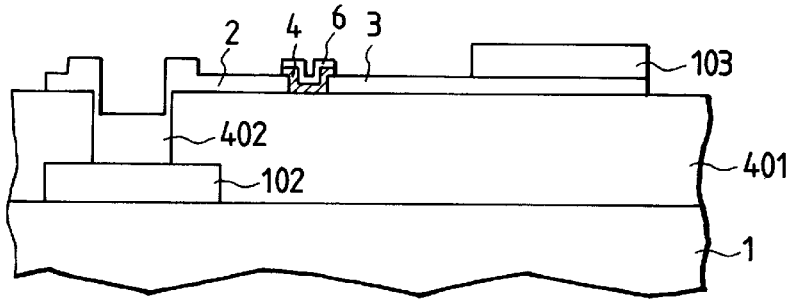
Figure 17I:
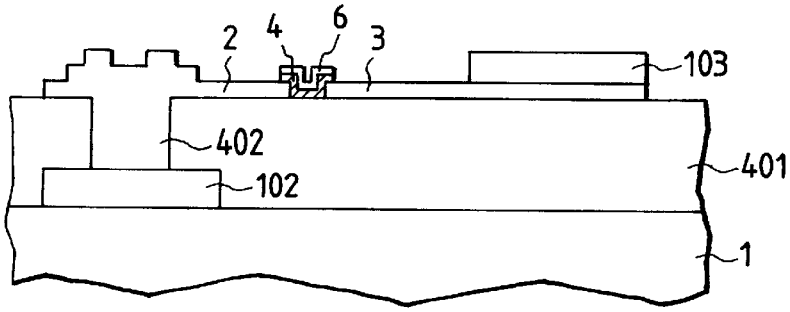

FIG. 15 is a partial plan view of the electron source prepared in these examples. FIG. 16 is a cross sectional view taken along line 16—16.

In FIGS. 15 and 16, 1 denotes a substrate and 102 and 103 respectively denotes an X-directional wire (lower wire) and a Y-directional wire (upper wire). Otherwise, there are shown device electrodes 2 and 3, an electroconductive thin film 4, a metal oxide coat 6, an interlayer insulation layer 401 and a contact hole 402 for electrically connecting the device electrode 3 and the wire 102. Now, the method used for manufacturing the electron source will be described in terms of an electron-emitting device thereof by referring to FIGS. 17A through 17I. Note that the following manufacturing steps, or Step-a through Step-i, respectively correspond to FIGS. 17A through 17I.

Step-A

After thoroughly cleansing a soda lime glass plate a silicon oxide film was formed thereon to a thickness of 0.5 $\mu$m by sputtering to produce a substrate 1, on which Cr and Au were sequentially laid to thicknesses of 5 nm and 600 nm respectively and then a photoresist (AZ1370: available from Hoechst Corporation) was formed thereon by means of a spinner, while rotating the film, and baked. Thereafter, a photo-mask image was exposed to light and photochemically developed to produce a resist pattern for a lower wires 102 and then the deposited Au/Cr film was wet-etched to actually produce a lower wire 102 having a desired profile.

Step-B

A silicon oxide film was formed as an interlayer insulation layer 401 to a thickness of 1.0 $\mu$m by RF sputtering.

Step-C

A photoresist pattern was prepared for producing a contact hole 402 in the silicon oxide film deposited in Step-b, which contact hole 402 was then actually formed by etching the interlayer insulation layer 401, using the photoresist pattern for a mask. A technique of RIE (Reactive Ion Etching) using $CF_4$ and $H_2$ gas was employed for the etching operation.

Step-D

Thereafter, a pattern of photoresist (RD-2000N-41: available from Hitachi Chemical Co., Ltd.) was formed for a pair of device electrodes 2 and 3 and then Ti and Ni were sequentially deposited thereon respectively to thicknesses of 5 nm and 100 nm by vacuum deposition. The photoresist pattern was dissolved into an organic solvent and the Ni/Ti deposit film was treated by using a lift-off technique to produce a pair of device electrodes 2 and 3.

Step-E

A photoresist pattern was prepared for upper wire 103 on the device electrodes 2 and 3 and Ti and Au were sequentially deposited by vacuum deposition to respective thicknesses of 5 nm and 500 nm. All the unnecessary portions of the photoresist was removed to produce an upper wire 103 having a desired profile by means of a lift-off technique.

Step-F

Then, a Cr film 403 was formed to a film thickness of 100 nm by vacuum deposition and patterned to produce a desired profile by using a mask having an opening for the contour of the electroconductive film 4. A solution of a Pd compound (ccp4230: available from Okuno Pharmaceutical Co., Ltd.) was applied onto the Cr film by means of a spinner and baked at 300° C. for 10 minutes to produce an electroconductive thin film 4 made of PdO fine particles and having a film thickness of 10 nm.

Step-G

A metal oxide (MgO) was deposited by evaporation as in Step-c of Example 1 to produce a metal oxide coat 6.

Step-H

The Cr film 403 was removed along with any unnecessary portions of the electroconductive film 133 of PdO fine particles and the metal oxide coat 6 by wet etching, using an acidic etchant to produce a pattern having a desired profile. The electroconductive thin film 4 showed an electric resistance of $Rs=5\times10^4\Omega/\square$ or so.

Step-I

Resist was applied to the entire surface except the contact hole 402 to form a resist pattern and Ti and Au were sequentially deposited to respective thicknesses of 5 nm and 500 nm. Then, any unnecessary areas were removed by means of a lift-off technique to bury the contact hole.

As a result of the above steps, a lower wire 102, an interlayer insulation layer 401, an upper wire 103, a pair of device electrodes 2 and 3, an electroconductive thin film 4 and a metal oxide coat 6 were formed on the substrate 1 for each device to produce an electron source that had to be subjected to an energization forming process.

Then, the prepared electron source that had not been subjected to energization forming was used to prepare an image-forming apparatus by following the steps described below. This will be described by referring to FIGS. 10 and 11A.

After securing an electron source substrate 1 onto a rear plate 111, a face plate 116 (carrying a fluorescent film 114 and a metal back 115 on the inner surface of a glass substrate 113) was arranged with a support frame 112 disposed therebetween and, subsequently, frit glass was applied to the contact areas of the face plate 116, the support frame 112 and the rear plate 111 and baked at 400° C. in the atmosphere for 10 minutes to hermetically seal the container. The substrate 1 was also secured to the rear plate 111 by means of frit glass.

While the fluorescent film 114 is consisted only of a fluorescent body if the apparatus is for black and white images, the fluorescent film 114 of this example (FIG. 11A) was prepared by forming black stripes in the first place and filling the gaps with stripe-shaped fluorescent members 122 of primary colors. The black stripes were made of a popular material containing graphite as a principal ingredient. A slurry technique was used for applying fluorescent materials onto the glass substrate 113.

A metal back 115 is arranged on the inner surface of the fluorescent film 114. After preparing the fluorescent film 114, the metal back 115 was prepared by carrying out a smoothing operation (normally referred to as "filming") on the inner surface of the fluorescent film 114 and thereafter forming thereon an aluminum layer by vacuum deposition.

While a transparent electrode may be arranged on the face plate 116 on the out side of the fluorescent film 114 in order to enhance the electroconductive of the fluorescent film 114, no such transparent electrode was used in this example because the metal back 115 provided a sufficient electroconductivity.

For the above bonding operation, the components were carefully aligned in order to ensure an accurate positional correspondence between the color fluorescent members 122 and the electron-emitting devices 104.

The image forming apparatus was then placed in a vacuum processing system and the vacuum chamber was evacuated by way of an exhaust pipe (not shown) to reduced the internal pressure to less than $1.3\times10^{-3}$ Pa, when an energization forming process was conducted by applying a pulse voltage to the device electrodes 2 and 3 of each of the electron-emitting devices 104 by way of the external terminals Dx1 through Dxm and Dy1 through Dyn to produce an electron-emitting region 5 for each of the electron-emitting devices. The employed pulse voltage was a rectangular pulse having a pulse width of 1 msec. and a pulse interval of 10 msec. The internal pressure of the envelope was further reduced by this process.

Thereafter, n-hexane was introduced into the envelope 118 until the pressure rose to $1.3\times10^{-3}$ Pa. A rectangular pulse whose pulse width and pulse interval were same as the one used for the energization forming process was also applied to the device for activation, observing the device current If and the emission current Ie. The pulse wave height was 14V.

After the activation process, the envelope 118 was evacuated again to reduce the internal pressure, while heating the entire envelope 118 to 190° C. for two hours, and the exhaust pipe (not shown) was heated to melt by a gas burner to hermetically seal the envelope when the internal pressure fell to about $1.3\times10^{-6}$ Pa. Finally, the getter (not shown) arranged in the envelope 118 was heated by high frequency heating to carry out a getter process.

The prepared display pane 201 (FIG. 10) was driven to operate for displaying images by applying scan signals and modulation signals to the electron-emitting devices 104 from a signal generating means (not shown) by way of the external terminals Dx1 through Dxm and Dy1 through Dyn to cause the devices to emit electrons and also by applying a high voltage of several kV or more to the metal back 115 by way of the high voltage terminals Hv to accelerate electron beams and cause them to collide with the fluorescent film 114 for excitation and light emission.

The image-forming apparatus of this embodiment operated stably to produce clear images for a prolonged period of time.

EXAMPLE 20

Figure 18:
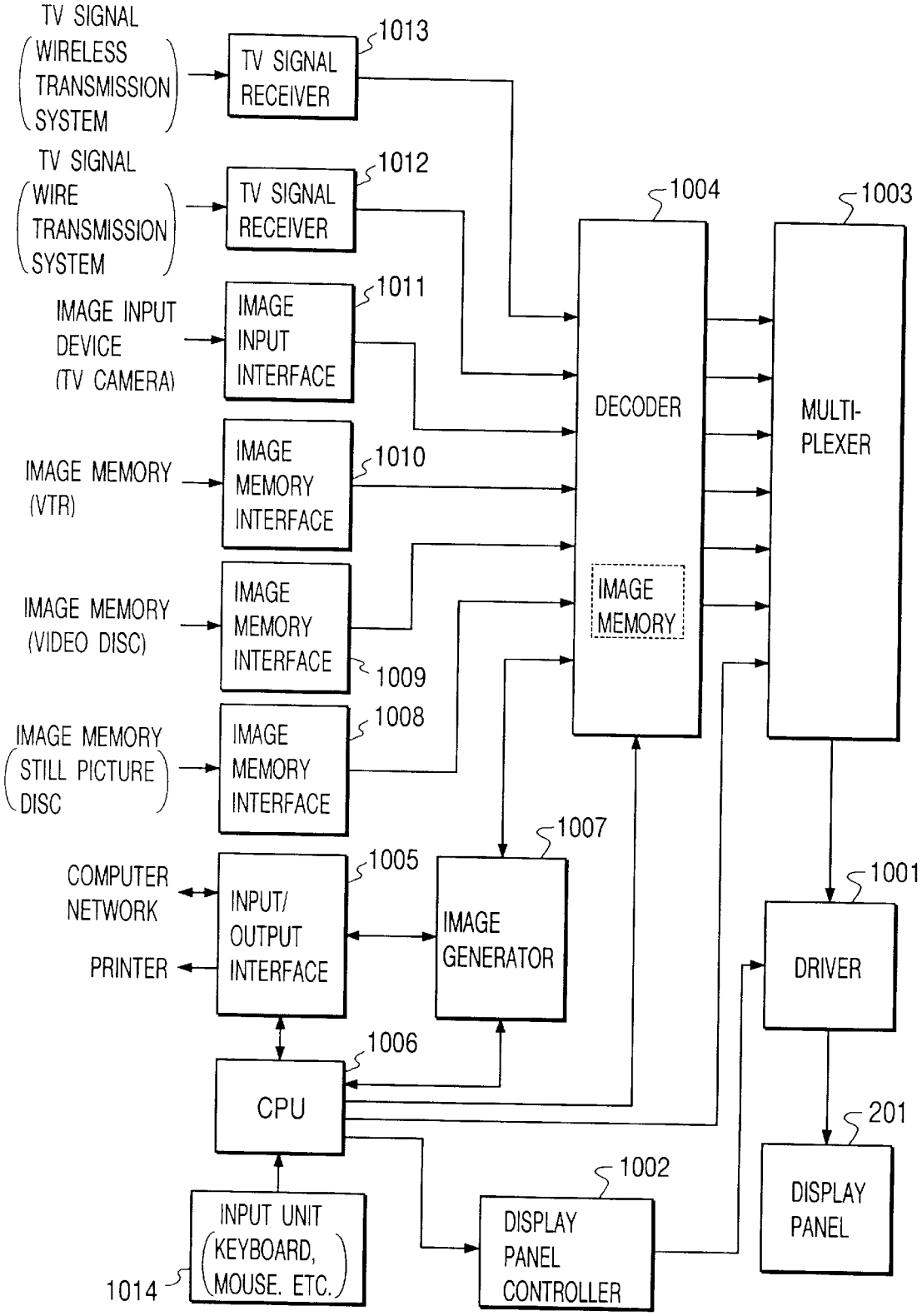
FIG. 18 is a schematic block diagram of an image-forming apparatus according to the invention.

FIG. 18 is a block diagram of a display apparatus realized by using a method according to the invention and a display panel (FIG. 10) prepared in the above example and arranged to provide visual information coming from a variety of sources of information including television transmission and other image sources.

In FIG. 18, there are shown a display panel 201, a display panel drive circuit 1001, a display panel controller 1002, a multiplexer 1003, a decoder 1004, an input/output interface circuit 1005, a CPU 1006, an image generator 1007, image input memory interface circuits 1008, 1009 and 1010, an image input interface circuit 1011, TV signal receivers 1012 and 1013 and an input unit 1014.

If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.

Now, the components of the apparatus will be described, following the flow of image signals therethrough.

Firstly, the TV signal receiver 1013 is a circuit for receiving TV image signals transmitted via a wireless transmission system using electromagnetic waves and/or spatial optical telecommunication networks.

The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

The TV signals received by the TV signal receiver 1013 are forwarded to the decoder 1004.

The TV signal receiver 1012 is a circuit for receiving TV image signals transmitted via a wired transmission system using coaxial cables and/or optical fibers. Like the TV signal receiver 1013, the TV signal system to be used is not limited to a particular one and the TV signals received by the circuit are forwarded to the decoder 1004.

The image input interface circuit 1011 is a circuit for receiving image signals forwarded from an image input device such as a TV camera or an image pick-up scanner. It also forwards the received image signals to the decoder 1004.

The image input memory interface circuit 1010 is a circuit for retrieving image signals stored in a video tape recorder (hereinafter referred to as VTR) and the retrieved image signals are also forwarded to the decoder 1004.

The image input memory interface circuit 1009 is a circuit for retrieving image signals stored in a video disc and the retrieved image signals are also forwarded to the decoder 1004

The image input memory interface circuit 1008 is a circuit for retrieving image signals stored in a device for storing still image data such as so-called still disc and the retrieved image signals are also forwarded to the decoder 1004.

The input/output interface circuit 1005 is a circuit for connecting the display apparatus and an external output signal source such as a computer, a computer network or a printer. It carries out input/output operations for image data and data on characters and graphics and, if appropriate, for control signals and numerical data between the CPU 1006 of the display apparatus and an external output signal source.

The image generation circuit 1007 is a circuit for generating image data to be displayed on the display screen on the basis of the image data and the data on characters and graphics input from an external output signal source via the input/output interface circuit 1005 or those se coming from the CPU 1006. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit for display are sent to the decoder 1004 and, if appropriate, they may also be sent to an external circuit such as a computer network or a printer via the input/output interface circuit 1005.

The CPU 1006 controls the display apparatus and carries out the operation of generating, selecting and editing images to be displayed on the display screen.

For example, it sends control signals to the multiplexer 1003 and appropriately selects or combines signals for images to be displayed on the display screen. At the same time it generates control signals for the display panel controller 1002 and controls the operation of the display apparatus in terms of image display frequency, scanning method (e.g., interlaced scanning or non-interlaced scanning), the number of scanning lines per frame and so on. The CPU also sends out image data and data on characters and graphic directly to the image generation circuit 1007 and accesses external computers and memories via the input/output interface circuit 1005 to obtain external image data and data on characters and graphics.

The CPU 1006 may additionally be so designed as to participate other operations of the display apparatus including the operation of generating and processing data like the CPU of a personal computer or a word processor. The CPU 1007 may also be connected to an external computer network via the input/output interface circuit 1005 to carry out computations and other operations, cooperating therewith.

The input unit 1014 is used for forwarding the instructions, programs and data given to it by the operator to the CPU 1006. As a matter of fact, it may be selected from a variety of input devices such as keyboards, mice, joysticks, bar code readers and voice recognition devices as well as any combinations thereof.

The decoder 1004 is a circuit for converting various image signals input via said circuits 1007 through 1013 back into signals for three primary colors, luminance signals and I and Q signals. Preferably, the decoder 1004 comprises image memories as indicated by a dotted line in FIG. 22 for dealing with television signals such as those of the MUSE system that require image memories for signal conversion.

The provision of image memories additionally facilitates the display of still images as well as such operations as thinning out, interpolating, enlarging, reducing, synthesizing and editing frames to be optionally carried out by the decoder 1004 in cooperation with the image generation circuit 1007 and the CPU 1006.

The multiplexer 1003 is used to appropriately select images to be displayed on the display screen according to control signals given by the CPU 1006. In other words, the multiplexer 1003 selects certain converted image signals coming from the decoder 1004 and sends them to the drive circuit 1001. It can also divide the display screen in a plurality of frames to display different images simultaneously by switching from a set of image signals to a different set of image signals within the time period for displaying a single frame.

The display panel controller 1002 is a circuit for controlling the operation of the drive circuit 1001 according to control signals transmitted from the CPU 1006.

Among others, it operates to transmit signals to the drive circuit 1001 for controlling the sequence of operations of the power source (not shown) for driving the display panel in order to define the basic operation of the display panel. It also transmits signals to the drive circuit 1001 for controlling the image display frequency and the scanning method (e.g., interlaced scanning or non-interlaced scanning) in order to define the mode of driving the display panel. If appropriate, it also transmits signals to the drive circuit 1001 for controlling the quality of the images to be displayed on the display screen in terms of luminance, contrast, color tone and sharpness. If appropriate, the display panel controller 1002 transmits control signals for controlling the quality of the image being displayed in terms of brightness, contrast, color tone and/or sharpness of the image to the drive circuit 1001.

The drive circuit 1001 is a circuit for generating drive signals to be applied to the display panel 201. It operates according to image signals coming from said multiplexer 1003 and control signals coming from the display panel controller 1002.

A display apparatus according to the invention and having a configuration as described above and illustrated in FIG. 22 can display on the display panel 1001 various images given from a variety of image data sources. More specifically, image signals such as television image signals are converted back by the decoder 1004 and then selected by the multiplexer 1003 before sent to the drive circuit 1001. On the other hand, the display controller 1002 generates control signals for controlling the operation of the drive circuit 1001 according to the image signals for the images to be displayed on the display panel 201. The drive circuit 1001 then applies drive signals to the display panel 201 according to the image signals and the control signals. Thus, images are displayed on the display panel 201. All the above described operations are controlled by the CPU 1006 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 1004, the image generation circuit 1007 and the CPU participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 18 shows only an example of possible configuration of a display apparatus comprising a display panel provided with an electron source prepared by arranging a number of surface conduction electron-emitting devices and the present invention is not limited thereto. For example, some of the circuit components of FIG. 18 that are not necessary for a particular application may be omitted.

To the contrary, additional components may be arranged there depending on the application. For example, if a display apparatus according to the invention is used for visual telephone, it may be appropriately made to comprise additional components such as a television camera, a microphone, lighting equipment and transmission/reception circuits including a modem. Since an image-forming apparatus according to the invention can be made very flat because the electron source itself comprising surface conduction electron-emitting devices does not require a large depth. In addition, the display panel can be made very large and have an enhanced brightness and a wide viewing angle to make it possible to display lively vivid images.

As described above in detail, the present invention provides an electron-emitting device that at operates excellently for electron emission for a prolonged period of time.

Thus, there can be provided an electron source having a large surface area and comprising a large number of electron-emitting devices. An image-forming apparatus comprising such an electron source can ensure an excellent brightness and a high contrast capability to remarkably improve the quality of the displayed images for a prolonged period of time.

Therefore, a large and flat display apparatus that can display bright and well contrasted images can be realized according to the invention.

What is claimed is:

1. An electron emitting device comprising:

(a) a pair of electrodes;

(b) a metal containing electroconductive film, wherein opposite ends of said electrically film are electrically connected to said pair of electrodes, respectively, and said electroconductive film has a gap formed at a part of said electroconductive film between said pair of electrodes;

(c) a metal oxide film, wherein said metal oxide film at least predominantly covers an area of said electroconductive film between said pair of electrodes, and said metal oxide film contains as a principal ingredient a metal oxide with a melting point higher than that of the principal ingredient of said electroconductive film; and (d) a carbon film, wherein said carbon film is disposed inside the gap and on said metal oxide film, and said carbon film comprises carbon, a carbon compound or a mixture thereof.

2. An electron-emitting device according to claim 1, wherein said metal oxide coat is formed as a layer on said electroconductive film and has a thickness not smaller than 1 nm and not greater than 20 nm.

3. An electron-emitting device according to claim 2, wherein said metal oxide coat has a thickness not smaller than 3.5 nm and not greater than 10 nm.

4. An electron-emitting device according to claim 1, wherein the molar percentage of a metal contained in the metal oxide coat relative to the metal contained in the electroconductive film is between 10% and 50%.

5. An electron-emitting device according to claim 1, wherein the metal oxide of the principal ingredient of said metal oxide coat has a work function lower than that of the material of the principal ingredient of said electroconductive film.

6. An electron-emitting device according to claim 1, wherein said metal oxide produces a vapor pressure of $1.3\times10^{-3}$ Pa at a temperature higher than the temperature at which the material of the principal ingredient of said electroconductive film produces the same vapor pressure.

7. An electron-emitting device according to claim 1, wherein said metal an oxide is oxide of at least a metal selected from Be, Mg, Sr, Ba, Y, La, Th, Ti, Zr, Hf, W, Fe and Al.

8. An electron-emitting device according to claim 1, wherein said metal-oxide coat contains carbonate of said metal at a rate of not greater than 50% in terms of the molar ratio of a metal element contained in the metal oxide.

9. An electron source comprising a plurality of electron-emitting devices according to any of claims 1 through 8 arranged on a substrate, wires connecting to the devices and means for driving the electron-emitting device.

10. An electron source according to claim 9, wherein it comprises one or more than one rows of a plurality of electron-emitting devices arranged on the substrate.

11. An electron source according to claim 10, wherein it comprises a plurality of rows of electron-emitting devices that are wired to form a matrix wiring arrangement.

12. An electron source according to claim 10, wherein it comprises a plurality of rows of electron-emitting devices that are wired to form a ladder-like wiring arrangement.

13. An image-forming apparatus comprising at least an electron source according to claim 9 and an image-forming member contained in a vacuum container.

14. An image-forming apparatus according to claim 13, wherein said image-forming member is a fluorescent body.

15. A method of manufacturing an electron-emitting device according to any of claims 1 through 8, comprising steps of:

applying a metal alkoxide solution to the electroconductive film; and pyrolyzing said metal alkoxide to produce metal oxide.

16. A method of manufacturing an electron-emitting device according to claim 15, wherein said metal alkoxide contains as alkyl group, an isopropyl group, a secondary butyl group or a tertiary butyl group.

17. A method of manufacturing an electron-emitting device according to claim 15, wherein said metal alkoxide contains at least a metal selected from Be, Mg, Sr, Ba, Y, La, Th, Ti, Zr, Hf, W, Fe and Al.

18. A method of manufacturing an electron-emitting device according to any of claims 1 through 8, comprising steps of:

forming a Langmuir-Blodgett (LB) film of metal salt of fatty acid or long chain amine/metal complex; and pyrolyzing the LB film to produce metal oxide.

19. A method of manufacturing an electron-emitting device according to claim 18, wherein said metal salt of fatty acid is metal salt of arachidic acid or stearic acid.

20. A method of manufacturing an electron-emitting device according to claim 18, wherein said long chain amine/metal complex is octadecylammonnium-metal oxalate complex.

21. A method of manufacturing an electron-emitting device according to claim 18, wherein said metal salt of fatty acid or long chain amine/metal complex contains at least a metal selected from Be, Mg, Sr, Ba, Y, La, Th, Ti, Zr, Hf, W, Fe and Al.

22. A method of manufacturing an electron source according to claim 9, wherein said electron-emitting device is manufactured by:

applying a metal alkoxide solution to the electroconductive film; and pyrolyzing said metal alkoxide to produce metal oxide.

23. A method of manufacturing an image-forming apparatus according to claim 13, wherein said electron-emitting device is manufactured by:

applying a metal alkoxide solution to the electroconductive film; and pyrolyzing said metal alkoxide to produce metal oxide.

24. A device according to claim 1, wherein said metal oxide coat containing as the principal ingredient a metal oxide with a melting point higher than that of the material of the principal ingredient of said electroconductive film covers the whole surface of said electroconductive film.

25. An electron emitting device comprising:

(a) a pair of electroconductive films, wherein a gap is formed between said pair of electroconductive films;

(b) a pair of electrodes, wherein one of said electrodes is connected to one of said electroconductive films, the other one of said electrodes is connected to the other one of said electroconductive films, and the gap is disposed between said electrodes;

(c) a metal oxide film, said metal oxide film at least predominantly covers an area of said electroconductive film between said pair of electrodes and said metal oxide film contains as a principal ingredient a metal oxide with a melting point higher than that of the material of the principal ingredient of said pair of electroconductive films; and (d) a carbon film, wherein said carbon film is disposed inside the gap, and on said metal oxide film, and said carbon film comprises carbon, a carbon compound or a mixture thereof.

26. An electron-emitting device according to claim 25, wherein said metal oxide coat is formed as a layer on said electroconductive film and has a thickness not smaller than 1 nm and not greater than 20 nm.

27. An electron-emitting device according to claim 26, wherein said metal oxide coat has a thickness not smaller than 3.5 nm and not greater than 10 nm.

28. An electron-emitting device according to claim 25, wherein the molar percentage of a metal contained in the metal oxide coat relative to the metal contained in the electroconductive film is between 10% and 50%.

29. An electron-emitting device according to claim 25, wherein the metal oxide of the principal ingredient of said metal oxide coat has a work function lower than that of the material of the principal ingredient of said electroconductive film.

30. An electron-emitting device according to claim 25, wherein said metal oxide produces a vapor pressure of $1.3\times10^{-3}$ Pa at a temperature higher than the temperature at which the material of the principal ingredient of said electroconductive film produces the same vapor pressure.

31. An electron-emitting device according to claim 25, wherein said metal oxide is an oxide of at least a metal selected from Be, Mg, Sr, Ba, Y, La, Th, Ti, Zr, Hf, W, Fe and Al.

32. An electron-emitting device according to claim 25, wherein said metal oxide coat contains carbonate of said metal at a rate of not greater than 50% in terms of the molar ratio of the metal element contained in the metal oxide.

33. An electron source comprising a plurality of electron-emitting devices according to any of claims 25 through 32 arranged on a substrate, wires connecting to the devices and means for driving the electron-emitting device.

34. An electron source according to claim 33, wherein it comprises one or more than one rows of a plurality of electron-emitting devices arranged on the substrate.

35. An electron source according to claim 33, wherein it comprises a plurality of rows of electron-emitting devices that are wired to form a matrix wiring arrangement.

36. An electron source according to claim 33, wherein it comprises a plurality of rows of electron-emitting devices that are wired to form a ladder-like wiring arrangement.

37. An image-forming apparatus comprising at least an electron source according to claim 33 and an image-forming member contained in a vacuum container.

38. An image-forming apparatus according to claim 37, wherein said image-forming member is a fluorescent body.

39. A device according to claim 1, wherein said metal oxide film is also disposed inside the gap.

40. An electron emitting device comprising:

(a) a pair of electrodes;

(b) an electroconductive film, wherein opposite ends of said electroconductive film are electrically connected to said pair of electrodes, respectively, and said electroconductive film has a gap formed at a part of said electroconductive film between said pair of electrodes;

(c) a carbon film, wherein said carbon film is disposed inside the gap and on said electroconductive film, and said carbon film comprising carbon, a carbon compound or mixture thereof; and (d) a metal oxide film, wherein said metal oxide film at least predominantly covers an area of said electroconductive film between said pair of electrodes, and said metal oxide film contains as a principal ingredient a metal oxide with a melting point higher than that of the material of the principal ingredient of said electroconductive film.

41. A device according to claim 40, wherein said metal oxide film is also disposed on said carbon film.

42. A device according to claim 40, wherein said metal oxide film is also disposed inside the gap.

43. An electron-emitting device according to claim 40, wherein said metal oxide coat is formed as a layer on said electroconductive film and has a thickness not smaller than 1 nm and not greater than 20 nm.

44. An electron-emitting device according to claim 43, wherein said metal oxide coat has a thickness not smaller than 3.5 nm and not greater than 10 nm.

45. An electron-emitting device according to claim 1, wherein the molar percentage of a metal contained in the metal oxide coat relative to the metal contained in the electroconductive film is between 10% and 50%.

46. An electron-emitting device according to claim 40, wherein the metal oxide of the principal ingredient of said metal oxide coat has a work function lower than that of the material of the principal ingredient of said electroconductive film.

47. An electron-emitting device according to claim 40, wherein said metal oxide produces a vapor pressure of $1.3\times10^{-3}$ Pa at a temperature higher than the temperature at which the material of the principal ingredient of said electroconductive film produces the same vapor pressure.

48. An electron-emitting device according to claim 40, wherein said metal oxide is an oxide of at least a metal selected from Be Mg, Sr, Ba, Y, La, Th, Ti, Zr, Hf, W, Fe and Al.

49. An electron-emitting device according to claim 40, wherein said metal oxide coat contains carbonate of said metal at a rate of not greater than 50% in terms of the molar ratio of a metal element contained in the metal oxide.

50. An electron source comprising a plurality of electron-emitting devices according to any of claims 40 through 49 arranged on a substrate, wires connected to the devices and means for driving the electron-emitting device.

51. An electron source according claim 50, wherein the electron source comprises one or more than one rows of a plurality of electron-emitting devices arranged on the substrate.

52. An electron source according to claim 51, wherein the electron source comprises a plurality of rows of electron-emitting devices that are wired to form a matrix wiring arrangement.

53. An electron source according to claim 51, wherein the electron source comprises a plurality of rows of electron-emitting devices that are wired to form a ladder-like wiring arrangement.

54. An image-forming apparatus comprising at least an electron source according to claim 50 and an image-forming member contained in a vacuum container.

55. An image-forming apparatus according to claim 54, wherein said image-forming member is a fluorescent body.

56. A method of manufacturing an electron-emitting device according to any of claims 40 through 49, comprising steps of:

applying a metal alkoxide solution to the electroconductive film; and pyrolyzing said metal alkoxide to produce metal oxide.

57. A method of manufacturing an electron-emitting device according to claim 55, wherein said metal alkoxide contains an alkyl group, an isopropyl group, a secondary butyl group or a tertiary butyl group.

58. A method of manufacturing an electron-emitting device according to claim 56, wherein said metal alkoxide contains at least a metal selected from the group consisting of Be, Mg, Sr, Ba, Y, La, Th, Ti, Zr, Hf, W, Fe and Al.

59. A method of manufacturing an electron-emitting device according to any of claims 40 through 49, comprising the steps of:

forming a Langmuir-Blodgett (LB) film of metal salt of fatty acid or long chain amine/metal complex; and pyrolyzing the LB film to produce metal oxide.

60. A device according to claim 40, wherein said metal oxide coat containing as the principal ingredient a metal oxide with a melting point higher than that of the material of the principal ingredient of said electroconductive film covers the whole surface of said electroconductive film.

61. An electron emitting device comprising:

(a) a pair of electrodes;

(b) an electroconductive film, wherein said electroconductive film comprises a conductive material and a metal oxide with a higher melting point than that of said conductive material, the opposite ends of said film being electrically connected to said electrodes, respectively, and said electroconductive film has a gap at a part of said electroconductive film; and (c) a carbon film, wherein said carbon film is disposed inside the gap and on said electroconductive film, said carbon film comprising carbon, a carbon compound or a mixture thereof.

62. A device according to claim 61, wherein the amount of a metal contained in said conductive material is 10% to 50% in terms of molar percentage of the amount of the metal contained in said metal oxide.

63. A device according to claim 61, wherein said conductive material has a work function lower than that of said metal oxide.

64. A device according to claim 61, wherein the temperature at which said metal oxide has a vapor pressure of $1.3\times10^{-3}$ Pa is higher than the temperature at which said conductive material has the same vapor pressure.

65. A device according to claim 61, wherein said metal oxide is an oxide of a metal selected from the group consisting of Be Mg, Sr, Ba, Y, La, Th, Ti, Zr, HE, W, Fe and Al.

66. A device according to claim 61, wherein said electroconductive film contains a carbonate of the metal in said metal oxide at a percentage not greater than 50% of the metal element contained in said metal oxide, in terms of molar percentage.

67. An electron source comprising a plurality of electron-emitting devices according to any of claims 61 through 66 arranged on a substrate, wires connecting to the devices and means for driving the electron-emitting device.

68. An electron source according to claim 67 wherein the electron source comprises one or more than one rows of a plurality of electron-emitting devices arranged on the substrate.

69. An electron source according to claim 68 wherein the electron source comprises a plurality of rows of electron-emitting devices that are wired to form a matrix wiring arrangement.

70. An electron source according to claim 68, wherein the electron source comprises a plurality of rows of electron-emitting devices that are wired to form a ladder-like wiring arrangement.

71. An image-forming apparatus comprising at least an electron source according to claim 67, and an image-forming member contianed in a vacuum container.

72. An image-forming apparatus according to claim 71, wherein said image-forming member is a fluorescent body.

73. A device according to claim 25, wherein said carbon film comprises a pair of carbon films; and between said pair of carbon films, a gap is formed.

74. A device according to claim 25, wherein the gap between said pair of carbon films is arranged inside of the gap between said electroconductive films; and the gap between said carbon films is narrower than the gap between said electroconductive film.

75. A device according to claim 25, wherein said metal oxide film is also disposed inside the gap.

76. An electron emitting device comprising:

(a ) a pair of electroconductive films, wherein a gap is formed between said pair of electroconductive films;

(b) a pair of electrodes, wherein one of said electrodes is connected to one of said pair of electroconductive films, and the other one of the electrodes is connected to the other one of said pair of electroconductive films, and the gap is disposed between said electrodes;

(c) a carbon film, wherein said carbon film is disposed inside the gap and on said pair of electroconductive films, said carbon film comprising carbon, a carbon compound or a mixture thereof; and (d) a metal oxide film, wherein said metal oxide film at least predominantly covers an area of said pair of electroconductive films between said pair of electrodes, and said metal oxide film contains as a principal ingredient a metal oxide with a melting point higher than that of the material of the principal ingredient of the electroconductive film.

77. A device according to claim 76, wherein said metal oxide film is also disposed on said carbon films.

78. A device according to claim 76, wherein said metal oxide film is also disposed inside the gap.

79. A device according to claim 76, wherein said carbon film comprises a pair of carbon films; and between said pair of carbon films, a gap is formed.

80. A device according to claim 76, wherein the gap between said carbon films is disposed inside of the gap between said electroconductive films; and the gap between said carbon films is narrower than the gap between said electroconductive films.

81. A device according to claim 76, wherein said metal oxide film is also disposed on said carbon film.

82. A device according to claim 76, wherein said metal oxide film is also disposed inside the gap between said carbon films.

83. An electron-emitting device according to claim 76, wherein said metal oxide coat is formed as a layer on said electroconductive film and has a thickness not smaller than 1 nm and not greater than 20 nm.

84. An electron-emitting device according to claim 83, wherein said metal oxide coat has a thickness not smaller than 3.5 nm and not greater than 10 nm.

85. An electron-emitting device according to claim 76, wherein the molar percentage of a metal contained in the metal oxide coat relative to the metal contained in the electroconductive film is between 10% and 50%.

86. An electron-emitting device according to claim 76, wherein the metal oxide of the principal ingredient of said metal oxide coat has a work function lower than that of the material of the principal ingredient of said electroconductive film.

87. An electron-emitting device according to claim 76, wherein said metal oxide produces a vapor pressure of $1.3\times10^{-3}$ Pa at a temperature higher than the temperature at which the material of the principal ingredient of said electroconductive film produces the same vapor pressure.

88. An electron-emitting device according to claim 76, wherein said metal oxide is an oxide of a metal selected from the group consisting of Be, Mg, Sr, Ba, Y, La, Th, Ti, Zr, Hf, W, Fe and Al.

89. An electron-emitting device according to claim 76, wherein said metal oxide coat contains a carbonate of said metal at a rate of not greater than 50%, in terms of the molar ratio of the metal element contained in the metal oxide.

90. An electron source comprising a plurality of electron-emitting devices according to any of claims 76 through 89 arranged on a substrate, wires connecting to the devices and means for driving the electron-emitting device.

91. An electron source according to claim 90, wherein the electron source comprises one or more than one row of a plurality of electron-emitting devices arranged on the substrate.

92. An electron source according to claim 90, wherein the electron source comprises a plurality of rows of electron-emitting device that are wired to form a matrix wiring arrangement.

93. An electron source according to claim 90, wherein the electron source comprises a plurality of rows of electron-emitting devices that are wired to form a ladder-like wiring arrangement.

94. An image-forming apparatus comprising at least an electron source according to claim 90 and an image-forming member, both contained in a vacuum container.

95. An image-forming apparatus according to claim 94, wherein said image-forming member is a fluorescent body.

96. An electron emitting device comprising:

(a) a pair of electroconductive films, wherein said electroconductive films comprise a conductive material and a metal oxide with a higher melting point than that of said conductive material, and a gap is formed between said electroconductive films;

(b) a pair of electrodes, wherein one of said electrodes is connected to one of said electroconductive films, the other of said electrodes is connected to the other of said electroconductive films, and the gap is disposed between said electrodes; and (c) a carbon film, wherein said carbon film is disposed inside the gap and on said electroconductive films and said carbon film comprises carbon, a carbon compound or a mixture thereof.

97. A device according to claim 96, wherein the ratio of metal contained in said conductive material to the metal contained in said metal oxide is 10%–50%, in terms of molar percentage.

98. A device according to claim 96, wherein said metal oxide has a lower work function rather than that of said conductive material.

99. A device according to claim 96, wherein a temperature at which said metal oxide has a vapor pressure of $1.3\times10^{-3}$ Pa is higher than the temperature at which said conductive material has the same vapor pressure.

100. A device according to claim 96, wherein said metal oxide is an oxide of a metal selected from the group consisting of Be, Mg, Sr, Ba, Y, La, Th, Ti, Zr, Hf, W, Fe and Al.

101. A device according to claim 97, wherein said electroconductive film contains a carbonate of a metal constituting said metal oxide at a percentage not greater than 50% of the metal element constituting said metal oxide, in terms of molar percentage.

102. A device according to claim 97, wherein said carbon film comprises a pair of carbon films; and between said pair of carbon films, a gap is formed.

103. A device according to claim 97, wherein the gap between said carbon films is arranged inside the gap between said electroconductive films; and the gap between said carbon films has a width narrower than that of the gap between said electroconductive films.

104. An electron source comprising a plurality of electron-emitting devices according to any of claims 96 through 103 arranged on a substrate, wires connecting to the devices and means for driving the electron-emitting device.

105. An electron source according to claim 104, wherein the electron source comprises one or more than one rows or a plurality of electron-emitting devices arranged on the substrate.

106. An electron source according to claim 105, wherein the electron source comprises a plurality of rows of electron-emitting devices that are wired to form a matrix wiring arrangement.

107. An electron source according to claim 105, wherein the electron source comprises a plurality of rows of electron-emitting devices that are wired to form a ladder-like wiring arrangement.

108. An image-forming apparatus comprising at least an electron source according to claim 104 and an image-forming member, both contained in a vacuum container.

109. An image-forming apparatus according to claim 108, wherein said image-forming member is a fluorescent body.

110. An electron-emitting device comprising:

a pair of oppositely disposed electrodes;

an electroconductive film electrically connecting said electrodes, and having an electron-emitting region formed as part thereof;

a deposited layer comprising carbon, a carbon compound, or a mixture thereof, on and around said electron-emitting region; and a metal oxide coat at least predominantly covering an area of said electroconductive film between said pair of electrodes, said metal oxide coat containing as a principal ingredient a metal oxide with a melting point higher than that of the material of the principal ingredient of said electroconductive film.

111. An electron-emitting device according to claim 110, wherein said metal oxide coat is formed as a layer on said electroconductive film and has a thickness of from 1 nm to 20 nm.

112. An electron-emitting device according to claim 111, wherein said metal oxide coat has a thickness of from 3.5 nm to 10 nm.

113. An electron-emitting device according to claim 110, wherein the amounts of metal contained in said metal oxide coat is 10% to 50% in terms of the molar percentage of the amount of the metal contained in said metal oxide coat, and wherein said metal oxide coat is contained at least in voids of the material of said electroconductive film.

114. An electron-emitting device according to claim 110, wherein the principal ingredients of said metal oxide coat is a metal oxide having a work function lower than that of the material of the principal ingredients of said electroconductive film.

115. An electron-emitting device according to claim 110, wherein the metal oxide coat produces a vapor pressure of $1.3\times10^{-3}$Pa at a temperature higher than the temperature at which the material of the principal ingredient of said electroconductive film produces the same vapor pressure.

116. An electron-emitting device according to claim 110, wherein said metal oxide is an oxide of at least one metal selected from the group consisting of Be, Mg, Sr, Ba, Y, La, Th, Ti, Zr, Hf, W, Fe, and Al.

117. An electron-emitting device according to claim 110, wherein said metal oxide coat contains a carbonate of the metal in said metal oxide at a percentage not greater than 50% of the metal element contained in said metal oxide, in terms of the molar percentage.

118. An electron-emitting device according to claim 110, wherein said metal oxide coat entirely covers said electroconductive film.

119. An electron-emitting device according to claim 110, wherein said electroconductive film has a first gap including said electron-emitting region, and said deposited narrower than the first gap and is connected to said electroconductive film.

120. An electron source comprising a plurality of electron-emitting devices according to any of claims 110 through 119 arranged on a substrate, conductors connecting to the devices, and means for driving the electron-emitting device.

121. An electron source according to claim 120, wherein said plurality of electron-emitting devices are arranged on the substrate in one or more rows.

122. An electron emitting source according to claim 121, wherein said rows of electron-emitting devices have a matrix wiring arrangement.

123. An electron source according to claim 121, wherein said rows of electron-emitting devices having a ladder wiring arrangement.

124. An image-forming apparatus comprising an electron source according to claim 120 and an image-forming member contained in a vacuum container.

125. An image-forming apparatus according to claim 124, wherein said image-forming member is a fluorescent body.

126. A method of manufacturing the electron-emitting device of any of claims 110 through 119, comprising the steps of:

providing a substrate having said pair of oppositely disposed electrodes and said electroconductive film that is electrically connected to said electrodes;

applying a metal alkoxide solution to said electroconductive film; and pyrolyzing said metal alkoxide to produce said metal oxide coat.

127. A method according to claim 126, wherein said metal alkoxide contains an alkyl group, an isopropyl group, and one of a secondary butyl group or a tertiary butyl group.

128. A method according to claim 126, wherein said metal alkoxide contains a metal selected from the group consisting of Be, Mg, Sr, Ba, Y, La, Th, Ti, Zr, Hf, W, Fe, and Al.

129. A method of manufacturing the electron-emitting device of any of claims 110 through 119, comprising the steps of:

providing a substrate having said pair of oppositely disposed electrodes and said electroconductive film electrically connecting said electrodes;

forming a Langmuir-Blodgett (LB) film of a metal salt of a fatty acid or a long chain amine/metal complex on said electroconductive film; and pyrolyzing said LB film to produce said metal oxide coat.

130. A method according to claim 129, wherein said metal salt of a fatty acid is a metal salt of arachidic acid or stearic acid.

131. A method according to claim 129, wherein said long chain amine/metal complex is an octadecylammonium-metal oxalate complex.

132. A method according to claim 129, wherein said metal salt of a fatty acid or long chain amine/metal complex contains at least one metal selected from the group consisting of Be, Mg, Ba, Y, La, Th, Ti, Zr, Hf, W, Fe and Al.

133. A method of manufacturing an electron source comprising (a) a plurality of electron-emitting devices according to claim 110 arranged on a substrate, (b) conductors connecting to the devices, and (c) means for driving the electron-emitting devices, wherein each electron-emitting device is manufactured by a method comprising the steps of:

providing a substrate having said pair of oppositely disposed electrodes and said electroconductive film electrically connected to said electrodes;

applying a metal alkoxide solution to said electroconductive film; and pyrolyzing said metal alkoxide to produce said metal oxide coat.

134. A method of manufacturing an electron source comprising (a) a plurality of electron-emitting devices according to claim 110 arranged on a substrate, (b) conductors connecting to the devices, and (c) means for driving the electron-emitting devices, wherein each electron-emitting device is manufactured by the method comprising the steps of:

providing a substrate having said pair of oppositely disposed electrodes and said electroconductive film electrically connected to said electrodes;

forming a Langmuir-Blodgett (LB) film of a metal salt of a fatty acid or a long chain amine/metal complex on said electroconductive film; and pyrolyzing said LB film to produce said metal oxide coat.

135. A method of manufacturing an image-forming apparatus comprising (a) an electron source comprising (i) a plurality of electron-emitting devices according to claim 110 arranged on a substrate, (ii) conductors connecting the devices, and (iii) means for driving the electron-emitting devices, and (b) an image-forming member contained in a vacuum container, wherein the electron source is manufactured by a method comprising the steps of:

providing a substrate having said pair of oppositely disposed electrodes and said electroconductive film electrically connected to said electrodes;

applying a metal alkoxide solution to said electroconductive film; and pyrolyzing said metal alkoxide to produce said metal oxide coat.

136. A method of manufacturing an image-forming apparatus comprising (a) an electron source comprising (i) a plurality of electron-emitting devices according to claim 110 arranged on a substrate, (ii) conductors connecting the devices, and (iii) means for driving the electron-emitting devices, and (b) an image forming member contained in a vacuum container, wherein the electron source is manufactured by a method comprising the steps of:

providing a substrate having said pair of oppositely disposed electrodes and said electroconductive film electrically connected to said electrodes;

forming a Langmuir-Blodgett (LB) film of a metal salt of a fatty acid or a long chain amine/metal complex on said electroconductive film; and pyrolyzing said LB film to produce said metal oxide coat.

* * * * *

UNITED STATES PATENT AND TRADEMARK OFFICE

CERTIFICATE OF CORRECTION

PATENT NO. : 6,184,610 B1
DATED : February 6, 2001
INVENTOR(S) : Masaaki Shibata et al.

It is certified that error appears in the above-identified patent and that said Letters Patent is hereby corrected as shown below:

Title page,
Item [56], References Cited, FOREIGN PATENT DOCUMENTS,
"1186740 7/1989 (JP)" should read -- 1-86740 7/1989 (JP) --;
"1213749 8/1989 (JP)" should read -- 1-231749 8/1989 (JP) --; and
"2257552 10/1990 (JP)" should read -- 2-257552 10/1990 (JP) --.
Item [56], References Cited, OTHER PUBLICATONS,
Amm et al. reference, "Fabrication" should read -- "Fabrication -- and
"deposition," should read -- deposition," --;
"Int. J. Electronics," vol. 69: reference, "Investigation" should read -- Investigations --;
"Influence of Organic Molecules"…. reference, "MINM" should read -- MIM --; and
"phy. stat. sol." should read -- Phys. Stat. Sol. --.
Item [57], ABSTRACT,
Line 6, "containing as principal ingredient with" should read -- containing as the principal ingredient a metal oxide with --.

Column 1,
Line 23, "Advance" should read -- Advances --; and
Line 24, ""PHYSICAL" should read -- "Physical --.

Column 2,
Line 10, "radder-like" should read -- ladder-like --; and
Line 56, "inventor" should read -- inventors --.

Column 3,
Line 63, "10" should read -- 10% --; and
Line 64, "electroconductive." should read -- electroconductive film. --.

Column 7,
Line 44, "Publication," should read -- Publications, --.

Column 8,
Line 8, "be" should be deleted; and
Line 34, "an" should read -- a --.

Column 9,
Line 7, "satisfactory." should read -- satisfactorily. --; and
Line 19, "occupy" should read -- occupies --.

UNITED STATES PATENT AND TRADEMARK OFFICE

CERTIFICATE OF CORRECTION

PATENT NO. : 6,184,610 B1
DATED : February 6, 2001
INVENTOR(S) : Masaaki Shibata et al.

It is certified that error appears in the above-identified patent and that said Letters Patent is hereby corrected as shown below:

Column 10,
Line 18, “preferably” should read -- preferable --; and
Line 65, “erably” should read -- erable --.

Column 11,
Line 41, “of” should be deleted;
Line 52, “moves” should read -- move --; and
Line 60, “eventually” should read -- eventually be --.

Column 12,
Line 16, “and” should be deleted.

Column 13,
Line 4, “is” should be deleted;
Line 13, “have” should read -- has --; and
Line 27, “electronrons” should read -- electrons --.

Column 14,
Line 14, “While” should be deleted and “various” should read -- Various --; and
Line 46, “carriers” should read -- carries --.

Column 15,
Line 29, “structuring modifying” should read -- structurally --; and
Line 61, “an” should read -- a --.

Column 16,
Line 29, “as,” should read -- as --.

Column 17,
Line 18, “performance of the” (2nd occurrence) should be deleted.

Column 18,
Line 22, “pump an ultra high” should read -- pump, and an ultra-high --; and
Line 64, “may various” should read -- may contain various --.

Column 19,
Line 49, “to” should read -- to as --.

UNITED STATES PATENT AND TRADEMARK OFFICE

CERTIFICATE OF CORRECTION

PATENT NO. : 6,184,610 B1
DATED : February 6, 2001
INVENTOR(S) : Masaaki Shibata et al.

It is certified that error appears in the above-identified patent and that said Letters Patent is hereby corrected as shown below:

Column 21,
Line 34, “400” should read -- 400º --; and
Line 48, “as” should read -- is --.

Column 22,
Line 4, “be” should be deleted; and
Line 52, “circuits” should read -- circuit --.

Column 23,
Line 30, “form” should read -- from --;
Line 34, “as” shoud read -- as is --;
Line 64, “emit” should read -- emits --; and
Line 65, “only” should read -- only when --.

Column 24,
Line 66, “devices” should read -- device -- and “emit” should read -- emits --.

Column 25,
Line 6, “according” should read -- according to --; and
Line 35, “examples” should read -- example, --.

Column 26,
Line 57, “was” should read -- were --; and
Line 62, “corresponding” should read -- corresponding to --.

Column 27,
Line 46, “device” should read -- the device --.

Column 28,
Line 42, “device” should read -- device with --.

Column 29,
Line 15, “do” should read -- does --; and
Line 33, “oxide” should read -- oxide coat --.

Column 31,
Line 20, “experiments,” should read -- experiment, --; and
Line 67, “and a” should read -- and an --.

UNITED STATES PATENT AND TRADEMARK OFFICE

CERTIFICATE OF CORRECTION

PATENT NO. : 6,184,610 B1
DATED : February 6, 2001
INVENTOR(S) : Masaaki Shibata et al.

It is certified that error appears in the above-identified patent and that said Letters Patent is hereby corrected as shown below:

Column 33,
Line 26, “through” should read -- trough --;
Line 66, “examples,” should read -- example, --.

Column 34,
Line 37, “wires” should read -- wire --; and
Line 65, “was” should read -- were --.

Column 35,
Line 65, “electroconductive” should read -- electroconductivity --.

Column 36,
Line 7, “reduced” should read -- reduce --.

Column 37,
Line 34, “1004” should read -- 1004. --;
Line 50, “se” should be deleted --; and
Line 54, “ing” should read -- ing to --.

Column 38,
Line 13, “participate” should read -- participate in --.

Column 39,
Line 11, “before” should read -- before being --;
Line 29, “participate” should read -- participate in --;
Line 58, “Since an” should read -- An --; and
Line 66, “at” should be deleted.

Column 40,
Line 11, “electron emitting” should read -- electron-emitting --;
Line 14, “electrically” (1st occurrence) should read -- electroconductive --; and
Line 51, “an” should be deleted; and “oxide” (2nd occurrence) should read -- an oxide --.

UNITED STATES PATENT AND TRADEMARK OFFICE

CERTIFICATE OF CORRECTION

PATENT NO. : 6,184,610 B1
DATED : February 6, 2001
INVENTOR(S) : Masaaki Shibata et al.

It is certified that error appears in the above-identified patent and that said Letters Patent is hereby corrected as shown below:

Column 41,
Line 34, “octadecylammonnium” should read -- octadecylammoníum --.

Column 42,
Line 1, “said” should read -- wherein said --.

Column 43,
Line 38, “Be” should read -- Be, --.

Column 44,
Line 49, “Be” should read -- Be --, and “HE,” should read -- Hf, --.

Column 45,
Line 7, “contianed” should read -- contained --.

Column 46,
Line 27, “device” should read -- devices --; and
Line 38, “electron emitting” should read -- electron-emitting --.

Column 47,
Line 58, “amounts” should read -- amount --;
Line 64, “ingredients” should read -- ingredient --;
Line 66, “ingredients” should read -- ingredient --.

Column 48,
Line 20, “deposited” should read -- deposited layer is arranged in the first gap to form a second gap --;
Line 31, “electron emitting” should read -- electron emitting --; and
Line 35, “having” should read -- have --.

UNITED STATES PATENT AND TRADEMARK OFFICE

CERTIFICATE OF CORRECTION

PATENT NO. : 6,184,610 B1
DATED : February 6, 2001
INVENTOR(S) : Masaaki Shibata et al.

It is certified that error appears in the above-identified patent and that said Letters Patent is hereby corrected as shown below:

Column 49,
Line 11, "Mg," should read -- Mg, St, --.

Signed and Sealed this

Ninth Day of July, 2002

*Attest:*

*Attesting Officer*

JAMES E. ROGAN
*Director of the United States Patent and Trademark Office*